US010648472B2

(12) United States Patent
Kienzle et al.

(10) Patent No.: US 10,648,472 B2
(45) Date of Patent: May 12, 2020

(54) SOUND ABSORBER FOR REFRIGERANT COMPRESSOR

(71) Applicant: Bitzer Kuehlmaschinenbau GmbH, Sindelfingen (DE)

(72) Inventors: Dominic Kienzle, Renningen (DE); Ashraf Agha, Sindelfingen (DE); Stephan Roelke, Filderstadt (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 504 days.

(21) Appl. No.: 14/490,104

(22) Filed: Sep. 18, 2014

(65) Prior Publication Data

US 2015/0004015 A1 Jan. 1, 2015

Related U.S. Application Data

(63) Continuation of application No. PCT/EP2013/055653, filed on Mar. 19, 2013.

(30) Foreign Application Priority Data

Mar. 20, 2012 (DE) ..... 10 2012 102 349

(51) Int. Cl.
*F04C 29/06* (2006.01)
*F01N 13/00* (2010.01)
(Continued)

(52) U.S. Cl.
CPC ..... *F04C 29/068* (2013.01); *F01N 1/083* (2013.01); *F01N 1/089* (2013.01); *F01N 13/002* (2013.01);
(Continued)

(58) Field of Classification Search
CPC ..... F04C 29/06; F04C 29/065; F04C 29/061; F04C 29/068; F04C 29/0035;
(Continued)

(56) References Cited

U.S. PATENT DOCUMENTS 2,943,641 A * 7/1960 Arnold ..... F04B 39/0055 138/26
4,746,277 A * 5/1988 Glanvall ..... F04C 29/065 181/403
(Continued)

FOREIGN PATENT DOCUMENTS

DE 10 2011 051 730 A1 1/2013
EP 1 715 238 A2 10/2006
(Continued)

*Primary Examiner* — Bryan M Lettman
(74) *Attorney, Agent, or Firm* — Reinhart Boerner Van Deuren P.C.

(57) ABSTRACT

In order to further improve the sound damping in a refrigerant compressor comprising a common housing, a screw-type compressor in a common housing has a compressor housing that is formed as part of the common housing with a first sound absorber unit which is arranged in the common housing. The first sound absorber unit is arranged adjacent a housing window, and the sound absorber unit comprises at least one chamber which is located between an inlet opening and an outlet opening and which widens out relative to the inlet opening and to the outlet opening in a direction transverse to a direction of flow.

37 Claims, 18 Drawing Sheets

(51) Int. Cl.
*F01N 1/08* (2006.01)
*F04C 29/12* (2006.01)
*F04C 29/00* (2006.01)

(52) U.S. Cl.
CPC ..... *F01N 13/007* (2013.01); *F04C 29/061* (2013.01); *F04C 29/065* (2013.01); *F04C 29/12* (2013.01); *F01N 2490/02* (2013.01); *F01N 2490/08* (2013.01); *F01N 2490/20* (2013.01); *F04C 29/0035* (2013.01); *F04C 2240/804* (2013.01); *F04C 2250/10* (2013.01); *F04C 2250/102* (2013.01)

(58) Field of Classification Search
CPC .... F04C 2240/804; F04C 29/12; F04C 15/06; F04C 2250/102; F04C 2250/10; F04B 39/0061; F04B 39/0055; F04B 39/0088; F04B 53/004; F01N 1/089; F01N 1/083; F01N 13/002; F01N 13/007; F01N 13/02; F01N 2470/12; F01N 2490/08; F01N 2490/02; F01N 2490/12; F01N 2490/20; F01N 2490/15; F01N 2490/155; F01N 2490/16; F01N 2490/18
See application file for complete search history.

(56) References Cited

U.S. PATENT DOCUMENTS

| | | | | |
|---|---|---|---|---|
| 5,214,937 | A * | 6/1993 | Henrichs | B01D 50/002 181/403 |
| 5,475,189 | A * | 12/1995 | Field | F16L 55/0333 181/229 |
| 8,016,071 | B1 * | 9/2011 | Martinus | F04B 39/0061 181/268 |
| 2003/0077195 | A1 | 4/2003 | Okada et al. | |
| 2006/0065478 | A1 | 3/2006 | Rockwell | |
| 2006/0243520 | A1 * | 11/2006 | Hertenstein | F01C 21/10 181/229 |
| 2009/0060759 | A1 * | 3/2009 | Sishtla | F04B 39/005 417/312 |
| 2012/0048645 | A1 * | 3/2012 | Bussow | F04B 39/0044 181/229 |
| 2014/0127067 | A1 | 5/2014 | Kienzle | |

FOREIGN PATENT DOCUMENTS

| | | |
|---|---|---|
| GB | 2 186 031 A | 8/1987 |
| JP | H0828479 A | 1/1996 |
| JP | H0849682 A | 2/1996 |

* cited by examiner

A
B
C
10
12
14
16
18
22
26
34
38
42
44
46
48

106
S4
92
108
S3
56
90
82
54
58
85
89
88
84
87
104
S1
S2
86
94
24
52
22
99
102
98
100

16
42
68
212
72
140
148a
132
133
138
142
154
156
$D_{ik}$
$D_{id}$
152
$A_{k148}$
148b
150a
$A_{k150}$
150b
150c
200
38
210
214
216
166
164
146
160
162
144
184
168
172
180
182
174
176
48

SOUND ABSORBER FOR REFRIGERANT COMPRESSOR

CROSS REFERENCE TO RELATED PATENT APPLICATION

This application is a continuation of international application No. PCT/EP2013/055653 filed on Mar. 19, 2013.

This patent application claims the benefit of international application No. PCT/EP2013/055653 of Mar. 19, 2013 and German application number 10 2012 102 349.2 of Mar. 20, 2012, the teachings and disclosure of which are hereby incorporated in their entirety by reference thereto.

BACKGROUND OF THE INVENTION

The invention relates to a refrigerant compressor comprising a common housing, a screw-type compressor which is provided in the common housing and has a compressor housing that is formed as part of the common housing and in which there is arranged at least one screw rotor boring, at least one screw rotor that is arranged in the screw rotor boring such as to be rotatable about a rotational axis, a suction-side bearing unit for the screw rotor that is arranged on the compressor housing, at least one pressure-side bearing unit for the screw rotor that is arranged on the compressor housing and a housing window for compressed refrigerant that is provided on the compressor housing, and a first sound absorber unit which is arranged in the common housing window.

Refrigerant compressors of this type are known from the state of the art such as DE 103 59 032 A1 for example.

Consequently, the object of the invention is to further improve a refrigerant compressor of this type in regard to the sound proofing thereof.

SUMMARY OF THE INVENTION

In accordance with the invention, this object is achieved in the case of a refrigerant compressor of the type described hereinabove in that the first sound absorber unit is arranged in the pressure housing after the housing window, and in that the sound absorber unit comprises at least one chamber which is located between an inlet opening and an outlet opening and widens out relative to the inlet opening and to the outlet opening in a direction transverse to a direction of flow.

The advantage of the solution in accordance with the invention is to be seen in that because the sound absorber unit is provided directly after the housing window, the pressure pulsations in the refrigerant compressor cannot spread out over long distances, but rather, are damped out again by the sound absorber unit immediately after the occurrence thereof within the compressor housing at the outlet window.

In particular, the possibility is thereby opened up for the pressure pulsations not to spread out at all over any significant part of the refrigerant compressor, but rather, to be substantially damped out immediately after the occurrence thereof in the region of the outlet window and passage through the housing window so that the propagation of sound in the common housing of the refrigerant compressor is reduced to a large extent.

Up to this point, no details have been given in regard to the concrete arrangement of the sound absorber unit.

Accordingly, one advantageous solution envisages that the first sound absorber unit be arranged in a sound absorber housing adjoining the compressor housing in the region of the housing window.

A sound absorber housing of this type can be formed in the most varied of manners. Thus a gap could be located between the housing window and the sound absorber housing.

One advantageous solution envisages that the sound absorber housing fit tightly around the housing window and as a result the sound absorber housing itself receives the compressed refrigerant having the pressure pulsations directly at the housing window and fits closely around the housing window.

It is particularly expedient if the sound absorber housing itself forms the inlet opening, the outlet opening and the at least one chamber, i.e. that no additional insert parts are necessary in the sound absorber housing, but rather, the sound absorber housing forms the inlet opening, the outlet opening and the at least one chamber in the form of a unitary component.

Furthermore, in regard to the sound absorber housing, provision is preferably made for the sound absorber housing to be arranged beside a bearing housing accommodating the at least one pressure-side bearing unit, i.e. the bearing housing for the at least one pressure-side bearing unit, as seen in the direction of the rotational axes of the screw rotors, and the sound absorber housing do not follow one another but rather, are located beside each other and are thus arranged next to each other in a direction transverse to the axes of rotation.

Up to this point, no details have likewise been given in regard to the fixing of the sound absorber housing.

In principle, the sound absorber housing could be fixed to the pressure housing.

However, it is particularly expedient if the sound absorber housing is held on the compressor housing, whereby in particular, sealing of the sound absorber housing around the housing window is also easily realizable.

Since the bearing housing is usually also held on the compressor housing, both the sound absorber housing and the bearing housing are preferably held beside one another on the compressor housing.

In order to enable the sound absorber housing and the bearing housing to be arranged beside each other in a simple manner, one particularly expedient solution envisages that the sound absorber housing and the bearing housing be designed as parts of a combined housing, i.e. that both the bearing housing for the bearing units and the sound absorber housing for the at least one sound absorber unit are realized by the combined housing.

This enables economical production of the combined housing on the one hand and also simplifies the assembly of the bearing housing and the sound absorber housing on the other, particularly when the two of them are held on the compressor housing.

The most varied of solutions are conceivable for the construction of the combined housing.

For example, it is possible to manufacture the combined housing in one-piece manner.

For reasons of simplified fabrication of the combined housing, it is of advantage however if the combined housing is in multipart form.

For example, provision is made hereby for the combined housing to comprise a basic housing and a covering housing thereby simplifying the production and assembly of the combined housing.

In regard to the sub-dividing of the combined housing into the basic housing and the covering housing, the most varied ways of separating them are conceivable.

One advantageous solution envisages that the basic housing and the covering housing be separable by a separating plane running transversely relative to the rotational axis of the at least one screw rotor.

A separating plane extending in this manner enables the basic housing and the covering housing to be constructed and assembled in a particularly simple manner.

In particular, it is expedient to mount the basic housing on the compressor housing and to seat the covering housing on the basic housing and fix it to the basic housing.

For example, provision is made in a construction of this type for at least one part of the bearing housing and at least one part of the sound absorber housing to be formed in the basic housing.

Hereby for example, it is conceivable that at least one part of the chambers of the sound absorber unit be formed in the basic housing.

It is even more advantageous, if in addition partition walls located between the chambers are formed in the basic housing.

With a solution of this type, the sound absorber unit in accordance with the invention can be realized in a very simple and economical manner.

In particular, provision is preferably made for the basic housing to be a one-piece part.

For example, the basic part can be in the form of a cast part into which the chambers and the partition walls as well as the respective part of the bearing housing are formed so that the basic housing together with the respective part of the sound absorber unit and the covering housing is producible in a very simple manner.

Furthermore, as a supplement thereto, it is advantageous if the covering housing is a one-piece part. The second sound absorber unit is formed into the covering housing for example.

In particular, the covering housing is also manufactured as a cast part into which the corresponding part of the bearing housing and also the corresponding part of the sound absorber unit are formed for example.

In regard to the further construction of the sound absorber, provision is preferably made for the first sound absorber unit to comprise a receiving chamber which adjoins the outlet window and is followed by the inlet opening so that the first sound absorber unit can thereby be adapted to the outlet window in a simple manner, wherein the receiving chamber receives the compressed gas or refrigerant from the outlet window and supplies it to the inlet opening of the first sound absorber unit so that the receiving chamber caters in particular for matching the cross section of the outlet window to the cross section of the inlet opening.

A particularly expedient arrangement of the first sound absorber unit in accordance with the invention envisages that it be arranged in such a way that the compressed refrigerant is adapted to flow therethrough in a direction of flow which runs transversely relative to a pressure-side wall of the compressor housing and away therefrom, in particular, virtually parallel to a rotational axis of the at least one screw rotor, i.e. in a direction which includes an angle of maximally 30° with the rotational axis.

The first sound absorber unit in accordance with the invention can thus be arranged in a particularly space saving manner.

Furthermore, the first sound absorber unit preferably extends in a direction parallel to the rotational axes of the screw rotors over approximately the same distance as the bearing housing in order to achieve a constructionally space-saving solution.

In one advantageous solution, provision is made for the sound absorber unit to be in the form of a passage absorber which comprises at least one passage opening and at least one expansion chamber following upon this passage opening and wherein the inlet opening and the outlet opening likewise respectively form a passage opening for the at least one expansion chamber.

In other words, in this case the sound absorber unit achieves its damping function in that jumps in the cross-section between the passage openings and the expansion chambers and between the expansion chambers and the passage openings occur, whereby the magnitude of the damping process is dependent on the surface area ratios of these jumps in cross-sectional area.

Preferably, provision is made in a sound absorber unit of this type for it to comprise a plurality of passage openings each of which is followed by an expansion chamber.

In particular in this case, the sound absorber unit is constructed in such a way that an expansion chamber follows directly on each passage opening and preferably too, such that a passage opening again follows directly on each expansion chamber.

In the simplest case, in particular that of the realization of the sound absorber unit in the combined housing, the sound absorber unit can be formed in such a way that each passage opening flowing into an expansion chamber merges without projections into a chamber wall of the respective expansion chamber so that the expansion chamber and the passage openings can be manufactured in a simple manner, i.e. in particular, in the form of a one-piece part and in particular a cast part without undercuts.

Moreover, provision is likewise preferably made for the same reasons for a chamber wall in each expansion chamber to merge without projections into the passage opening leading away from the expansion chamber.

The sound absorber unit in accordance with the invention is producible in a particularly simple manner if a plurality of the passage openings of the sound absorber unit have identical cross sections.

It is particularly expedient if all passage openings of the sound absorber unit have identical cross sections.

In particular, it is advantageous thereby if the passage openings are aligned with one another.

Furthermore, provision is preferable made for the sound absorber unit to comprise a plurality of expansion chambers of differing volume, this thereby enabling the damping characteristics to be matched to different frequencies in a simple manner.

The differing volumes of the plurality of expansion chambers can be achieved in a particularly advantageous manner if the expansion chambers of differing volume have a different extent in the direction of flow.

As an alternative or in addition to the previous solutions relating to a passage absorber, a further advantageous solution envisages that the sound absorber unit comprise a tubing section extending from the inlet opening to the outlet opening and forming a through-flow channel which has casing-side through holes that open out into at least one damping space which is arranged in the at least one chamber and adjoins the tubing section.

In this case, the sound absorber unit no longer works as a passage absorber but rather, as a side branch resonator or Helmholtz resonator in which the damping space couples via the through holes to the flow channel transversely relative to the direction of flow and thus damps the pressure pulsations in the through-flow channel in the event of a resonant state defined by the through holes and the damping space.

Preferably hereby, provision is made for the tubing section to pass through a plurality of chambers each of which forms a damping space that adjoins the tubing section.

In this case, there is a resonant state for each of the damping spaces together with the through holes leading thereto.

Hereby, the damping spaces are separated from each other in the case of a plurality of damping spaces.

For example, provision is made for the sound absorber unit to comprise at least two damping spaces which have a different volume.

In particular, the different volumes of the damping spaces can be realized in that they have a different extent in the longitudinal direction of the tubing section.

In connection with the previous explanation of the individual exemplary embodiments of the solution in accordance with the invention, it was not defined in detail as to how the sound absorber unit should be arranged in the common housing.

For example, it would be conceivable for the common housing to be constructed in such a way that a part thereof forms the sound absorber housing.

In the case where the sound absorber housing and the bearing housing are combined into a combined housing, it is likewise conceivable for the common housing to be constructed in such a way that a part thereof forms the combined housing.

However, a further advantageous solution envisages that the sound absorber housing be arranged within a pressure housing of the common housing, i.e. that the sound absorber housing be in the form of a separate housing within the pressure housing.

This can be realized for example in that the pressure housing extends over the sound absorber housing thereby creating the possibility of further reducing the propagation of sound emerging from the sound absorber housing in the direction of the pressure housing.

In particular, it is expedient in connection herewith if the sound absorber housing is surrounded by a pressure space located in the pressure housing, whereby the pressure space ensures that a sound absorption process will occur between the sound absorber housing and the pressure housing.

In particular, the pressure space is a space into which the compressed gas or refrigerant enters only after passing through the sound absorber unit and thus the sound absorber housing so that the pressure pulsations of the compressed gas or refrigerant in the pressure space have already been damped out by the sound absorber unit.

Moreover, a further advantageous solution envisages that a lubricant separating unit be arranged in the pressure housing.

A lubricant separation process is thereby combinable with a sound proofing process in a simple manner.

Preferably, the lubricant separating unit is arranged in such a way that it is arranged downstream of the at least one sound absorber unit so that the compressed gas or refrigerant no longer exhibits pressure pulsations upon reaching the lubricant separating unit, something which is of advantage for a lubricant separation process, since pressure pulsations in the region of the lubricant separating unit lead to lubricant that has already been separated out being carried along again by the compressed gas or refrigerant due to the pressure surges.

Further features and advantages of the solution in accordance with the invention form the subject matter of the following description and the graphical illustration of some exemplary embodiments.

DETAILED DESCRIPTION OF THE INVENTION

Figure 1:
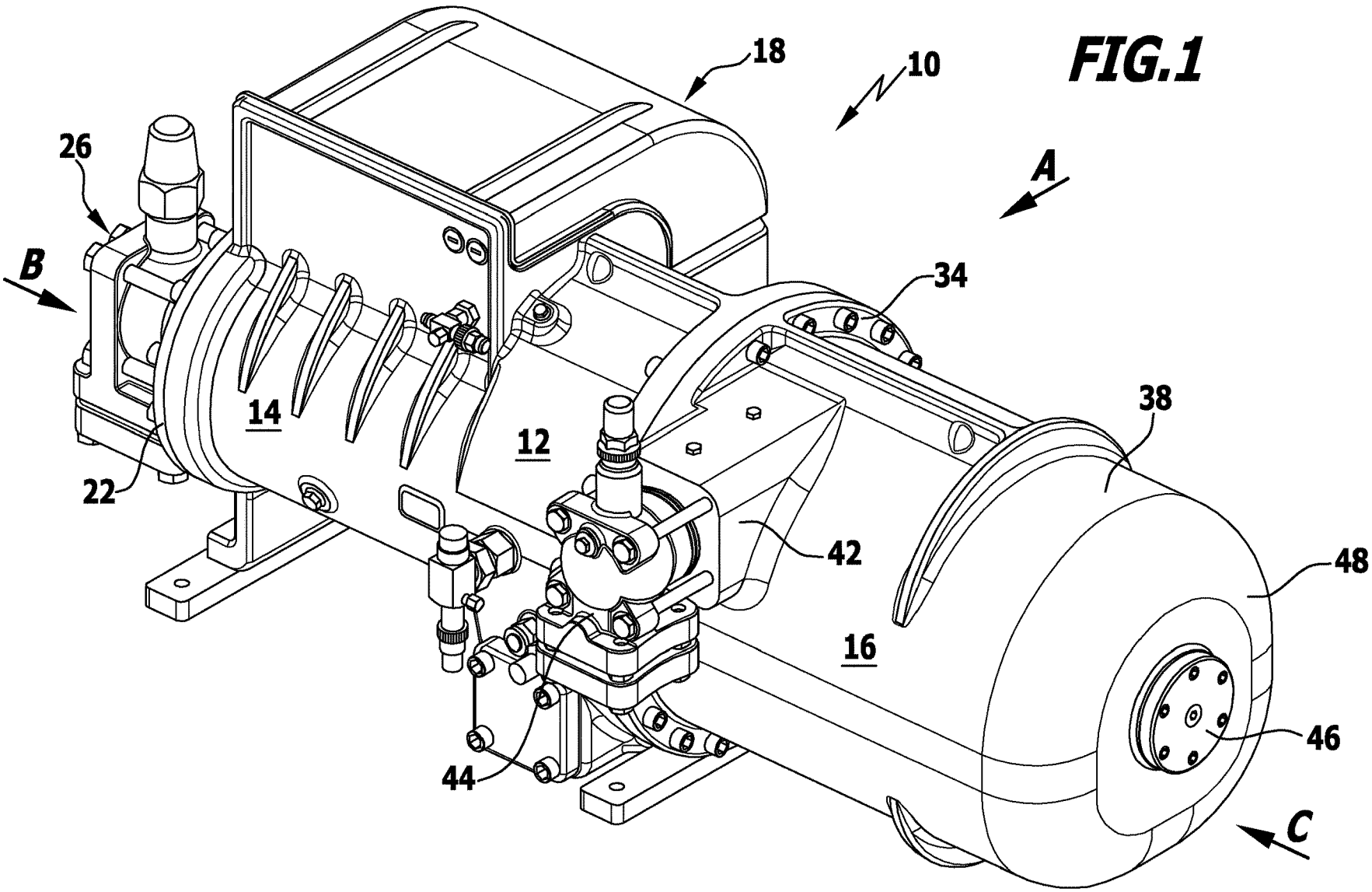
FIG. 1 shows a perspective view of a refrigerant compressor in accordance with the invention.
Figure 2:
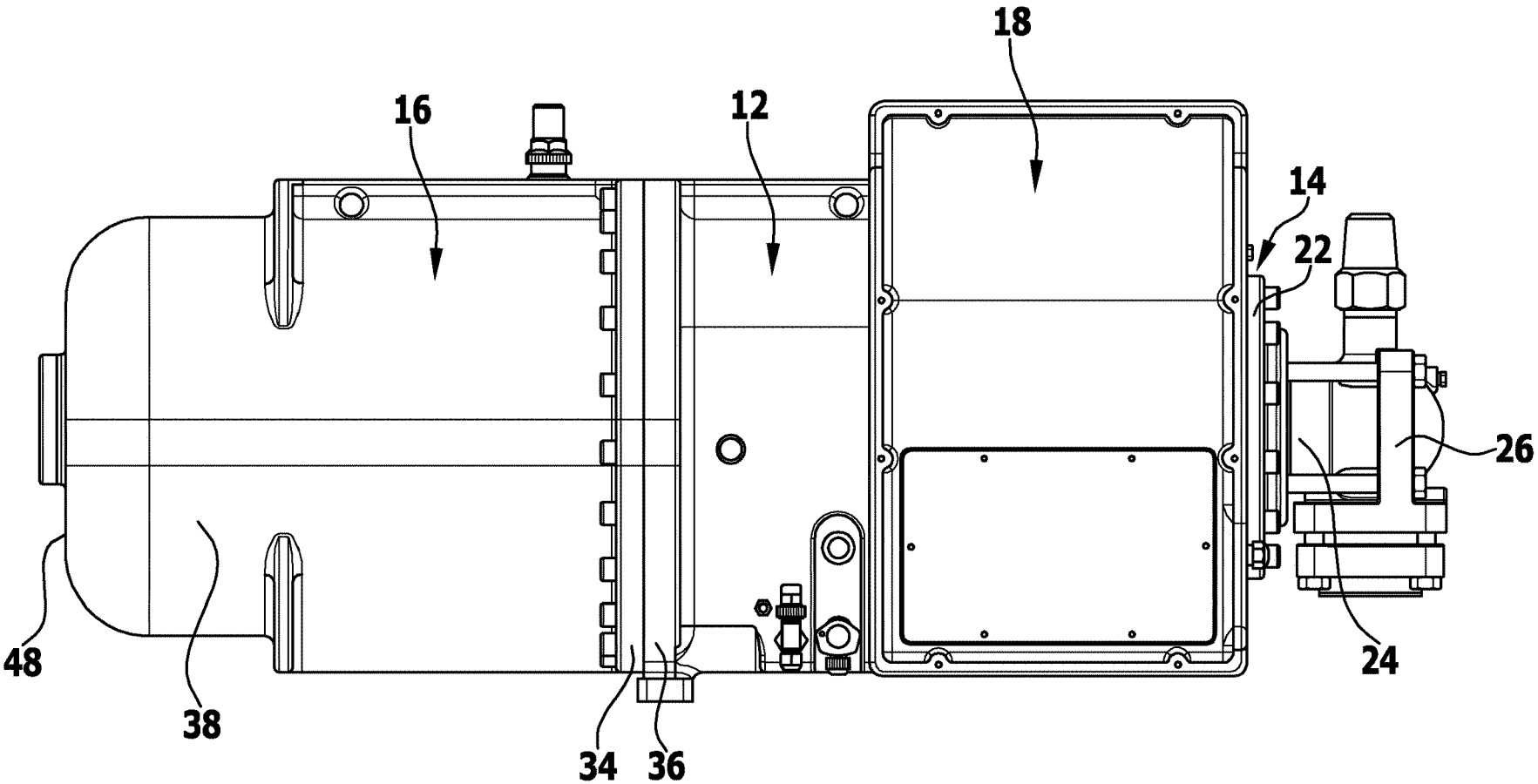
FIG. 2 a side view in the direction of the arrow A in FIG. 1.
Figure 3:
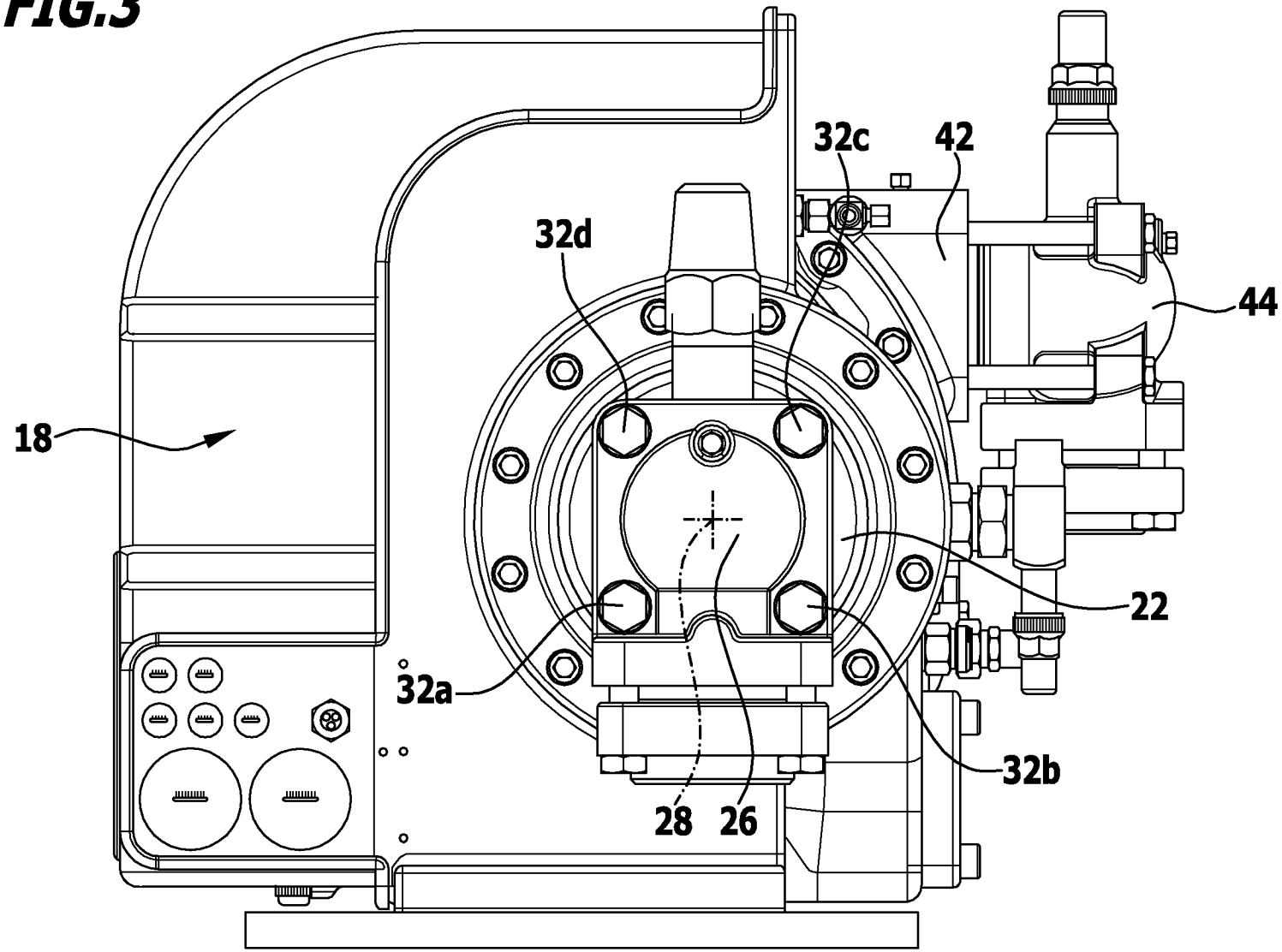
FIG. 3 a view in the direction of the arrow B in FIG. 1.

An exemplary embodiment of a refrigerant compressor 10 in accordance with the invention which is illustrated in FIGS. 1 to 3 comprises a common housing 11 which includes a compressor housing 12, a motor housing 14 arranged on a side of the compressor housing 12 and a pressure housing 16 arranged on a side of the compressor housing 12 opposite the motor housing 14. Hereby, the compressor housing 12, the motor housing 14 and the pressure housing 16 may be separate parts of the common housing 11 and are put together in order to form the latter or the compressor housing 12 and the motor housing 14 and/or the compressor housing 12 and the pressure housing 16 could be formed as connected parts.

Furthermore, the motor housing 14 carries a control system housing 18 which is located in the region of a partial periphery and in which a control system for the refrigerant compressor is arranged.

Figure 5:
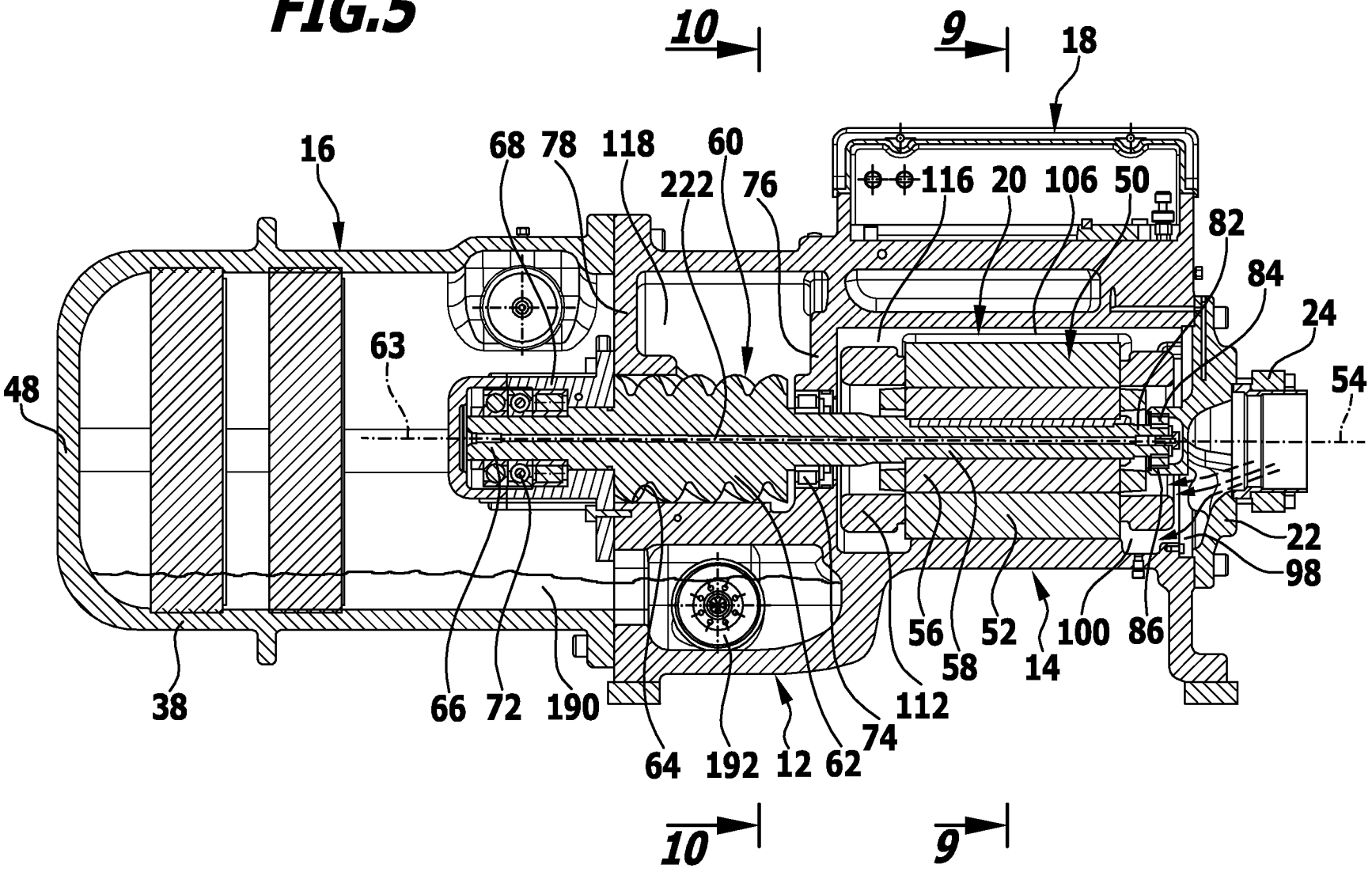
FIG. 5 a section along the line 5-5 in FIG. 4

As is illustrated in FIGS. 2, 3 and 5, the motor housing 14 surrounds a motor compartment 20 and is closed at the end thereof remote from the compressor housing 12 by an end face cover 22 which forms an end wall of the motor housing 14 and which, for its part, is provided with a suction gas connector 24 through which the refrigerant that is to be sucked to the refrigerant compressor is suppliable.

As is illustrated in FIGS. 2 and 3, the suction gas connector 24 is preferably provided with a shut-off valve 26 which is connected to a suction gas line leading to the refrigerant compressor but is not illustrated in the drawings.

In connection therewith, as is illustrated in FIG. 3, the shut-off valve 26 is mountable about an axis 28 in different rotational positions, in four rotational positions that are mutually displaced by 90° for example, in order to enable optimal matching to a not illustrated suction gas line that leads to the refrigerant compressor.

The possibility of being able to mount the shut-off valve 26 in different rotational positions is realizable in that there are arranged retaining screws 32*a*, 32*b*, 32*c* and 32*d* which are arranged with equal angular spacings about the axis 28 and with the aid of which the shut-off valve 26 is mountable relative to the cover 22 in the four rotational positions that are mutually displaced by 90°.

The pressure housing 16 is connected to the compressor housing 12 in releasable manner, namely, by means of a pressure housing flange 34 which is connectable to a mounting flange 36 of the compressor housing 12, whereby, commencing from the pressure housing flange 34, the pressure housing 16 extends in the form of a cylindrical jacket 38 that is closed at the end thereof by an end wall 48.

Furthermore the pressure housing 16 carries a compressed gas connector 42 on which a shut-off valve 44 is mountable on the compressed-gas-side.

Figure 4:
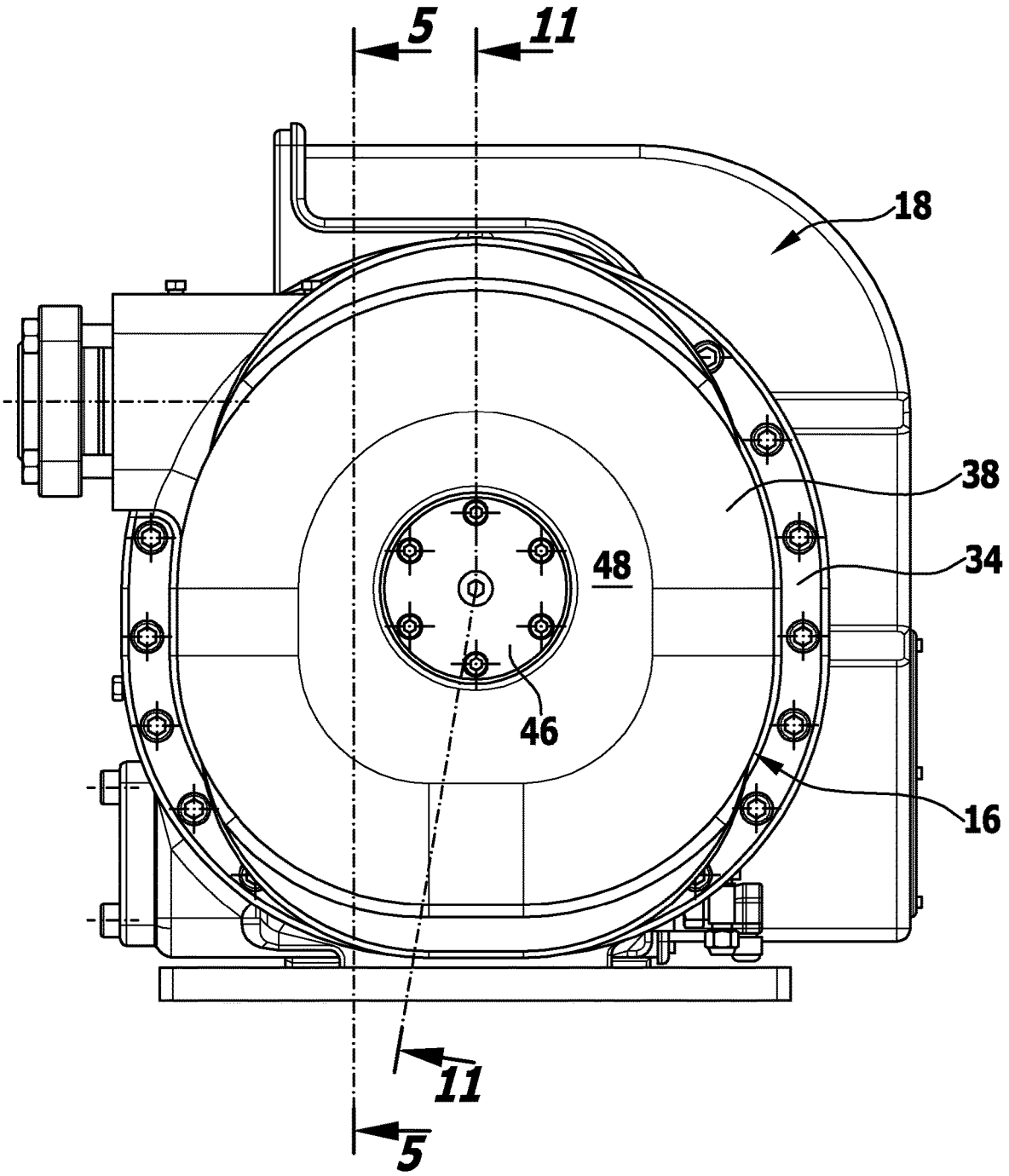
FIG. 4 a view in the direction of the arrow C in FIG. 1

Furthermore, the jacket 38 is preferably closed in accessible manner in the region of the end wall 48 thereof opposite the compressor housing 12 by an access cover 46 (FIGS. 1 and 4).

As is illustrated in FIG. 5, an electric motor bearing the general reference 50 is seated in the motor housing 14, a stator 52 is arranged fixedly in the motor housing 14 and there is also a rotor 56 which is mounted rotatably about a motor axis 54 relative to the stator 52, wherein the rotor 56 is seated on a drive shaft 58.

The drive shaft 58 passes through the rotor 56 in the direction of the motor axis 54 on the one hand and extends into the compressor housing 12 of a screw-type compressor bearing the general reference 60 on the other.

In the region thereof extending within the compressor housing 12, the drive shaft 58 carries a screw rotor 62 which is arranged in the compressor housing 12 in a screw rotor boring 64 and is rotatable therein about a rotational axis 63 coinciding with the motor axis 54.

Moreover, the drive shaft 58 extends on the side thereof opposite the electric motor 50 beyond the screw rotor 62 and forms an end section 66 which is rotatably mounted in a bearing housing 16 arranged within the pressure housing 68, wherein a set of bearings 72 is provided in the bearing housing 68 on the pressure-side for this purpose.

Furthermore, the drive shaft 58 is mounted between the screw rotor 62 and the rotor 56 in a suction-side set of bearings 74 adjoining the suction-side of the screw rotor 62.

For example, the suction-side set of bearings 74 is held on a suction-side wall 76 of the compressor housing 12, whilst the pressure-side set of bearings 72 is held on a pressure-side wall 78, wherein the bearing housing 68 is carried by the pressure-side wall 78 for this purpose.

For the purposes of accurately guiding the rotor 56 coaxially relative to the motor axis 54, the drive shaft 58 comprises another end section 82 which extends beyond the rotor 56 and which, for its part, is mounted in a guide bearing 84 that is seated in a bearing seating 86 which is arranged coaxially relative to the motor axis 54 and is fixed to the motor housing 14, namely close to the cover 22.

The bearing seating 86 could thus be supported directly on the motor housing 14 independently of the cover 22.

Figure 6:
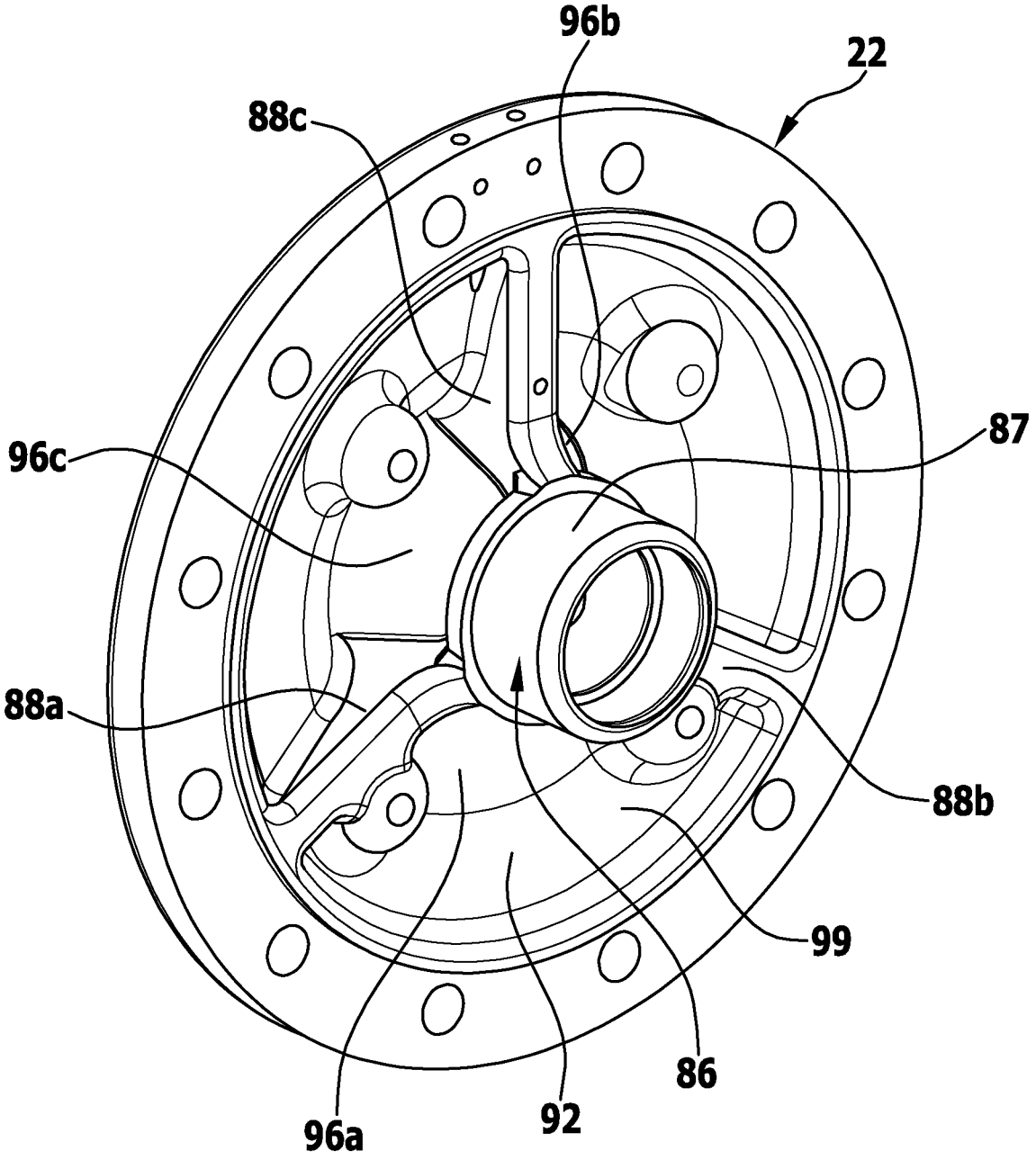
FIG. 6 a perspective illustration of an end face cover with a bearing seating in a view of the cover from the motor compartment.
Figure 7:
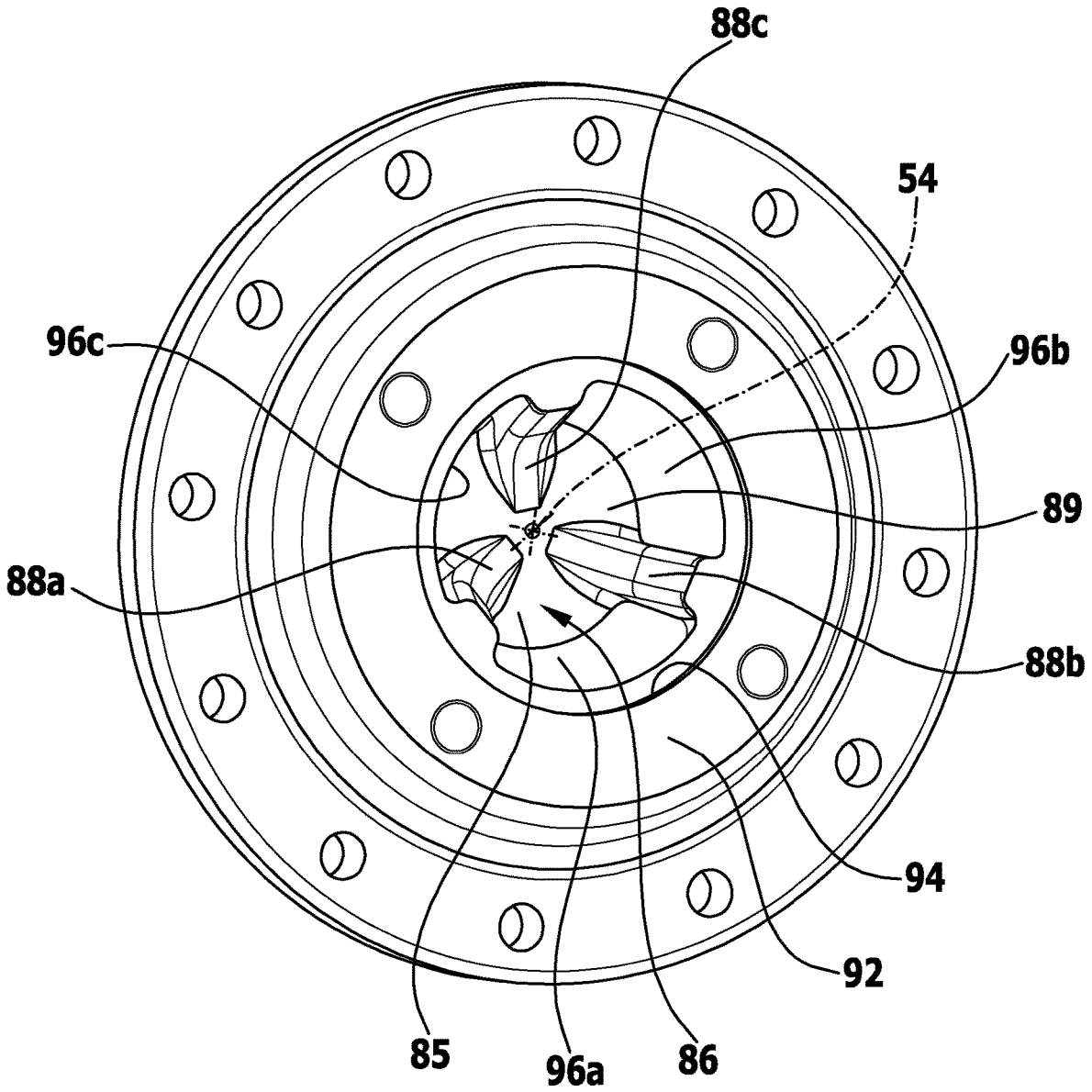
FIG. 7 a perspective illustration of the cover in accordance with FIG. 6 in a view of the cover from a suction gas connector.

Preferably, as is illustrated in FIG. 5, FIG. 6 and FIG. 7, the bearing seating 86 is held on the cover 22, wherein the bearing seating 86 is held spaced from a cover base 92 by means of a plurality of bars, for example, bars 88*a*, 88*b* or 88*c* which are arranged with the same angular separation from each other.

In particular, the bearing seating 86 comprises a seating base 85 which is carried by the bars 88*a*, 88*b* and 88*c*, and an annular body 87 which surrounds the guide bearing 84 in a radially outward direction.

Moreover, a suction opening 94 to which the suction gas connector 24 is connected and with which it is aligned is provided in the cover base 92.

Figure 8:
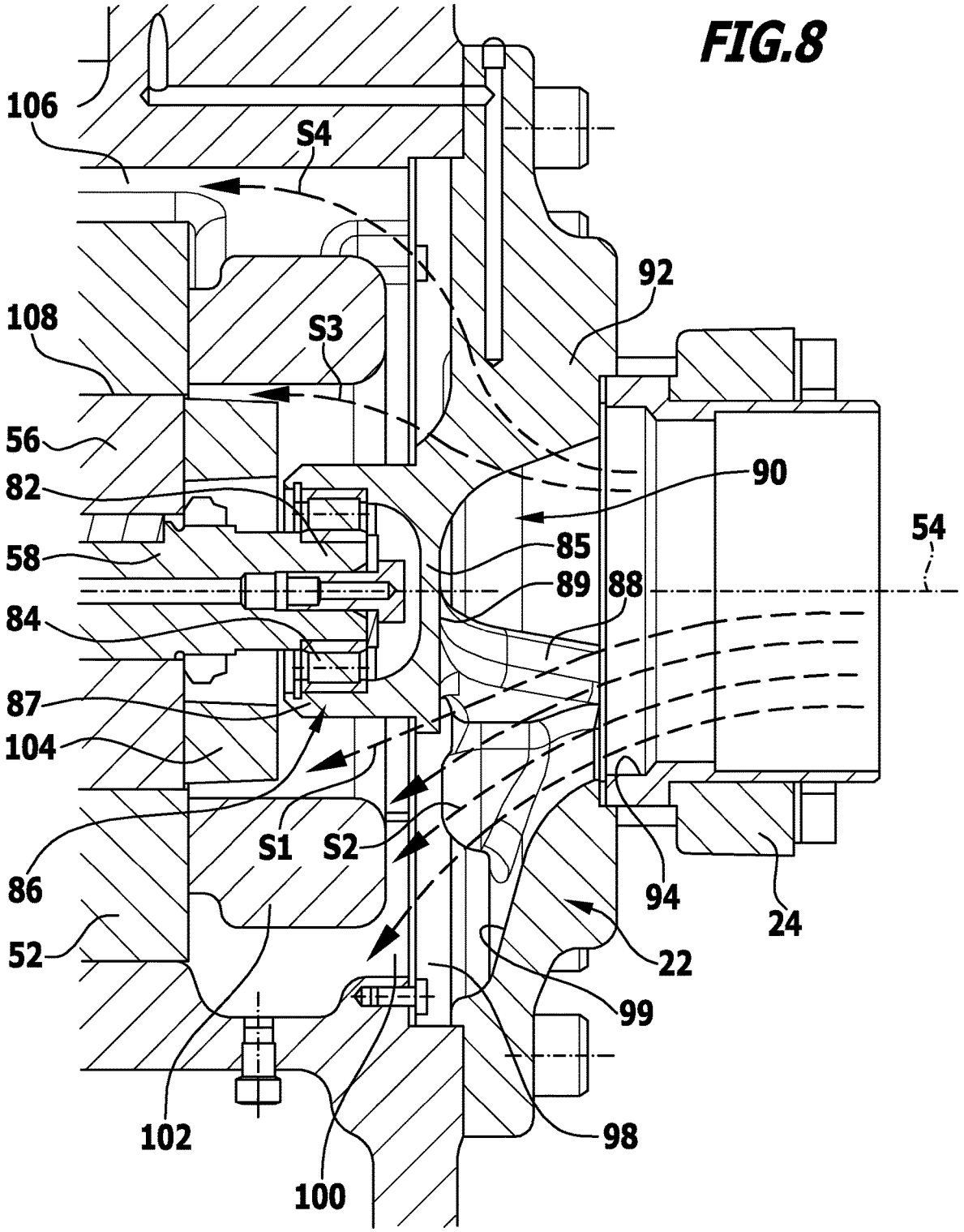
FIG. 8 an enlarged sectional view through the end face cover with the suction gas connector and the bearing seating.

The bearing seating 86 is held by the bars 88*a*, 88*b*, 88*c* such as to be spaced from the cover base 92 in such a manner that an in-flow space extending in the direction of the motor axis 54 and about the motor axis 54 is formed between the cover base 92 and the bearing seating 86, said space being surrounded by in-flow openings 96*a*, 96*b* and 96*c* which extend between the successive bars 88 in the circumferential direction and through which the suction gas can enter an end-face-side interior space 100 of the motor compartment 20 with a radial and axial component with respect to the motor axis 54, as is illustrated in FIG. 8 by the dashed lines.

Preferably, a suction gas filter 98 through which the suction gas must flow is arranged in an interior space 100 surrounding the bearing seating 86.

As is illustrated in FIGS. 5 and 8 by dashed lines, the suction gas flows from the shut-off valve 26 in a direction parallel to the motor axis 54 through the suction gas connector 24 and the suction opening 94 into the in-flow space 90 which is arranged between the suction opening 94 and the bearing seating 86.

From the in-flow space 90, a component of the suction gas running at an angle to the motor axis 54 then flows through the in-flow openings 96 into the interior space 100 thereby forming a plurality of flow paths S.

For example, a first flow path S1 flows to the bearing seating 86 in the region of the outer ring-like body 87 which surrounds the guide bearing 84 radially outwardly and preferably flows around the ring-like body 87 so that the bearing seating is cooled.

Furthermore, this flow path S1 also flows to that end face 104 of the rotor 56 which is remote from the compressor housing.

Furthermore for example, a flow path S2 flows to the stator 52 in the region of its head windings 102 which are remote from the compressor housing 12 in order to cool them.

A further flow path S3 for example, opens up the possibility of a flow through a gap 108 between the rotor 56 and the stator 52 in the direction of the compressor housing 12 so that both cooling of the stator 52 and cooling of the rotor 56 likewise occurs.

Figure 9:
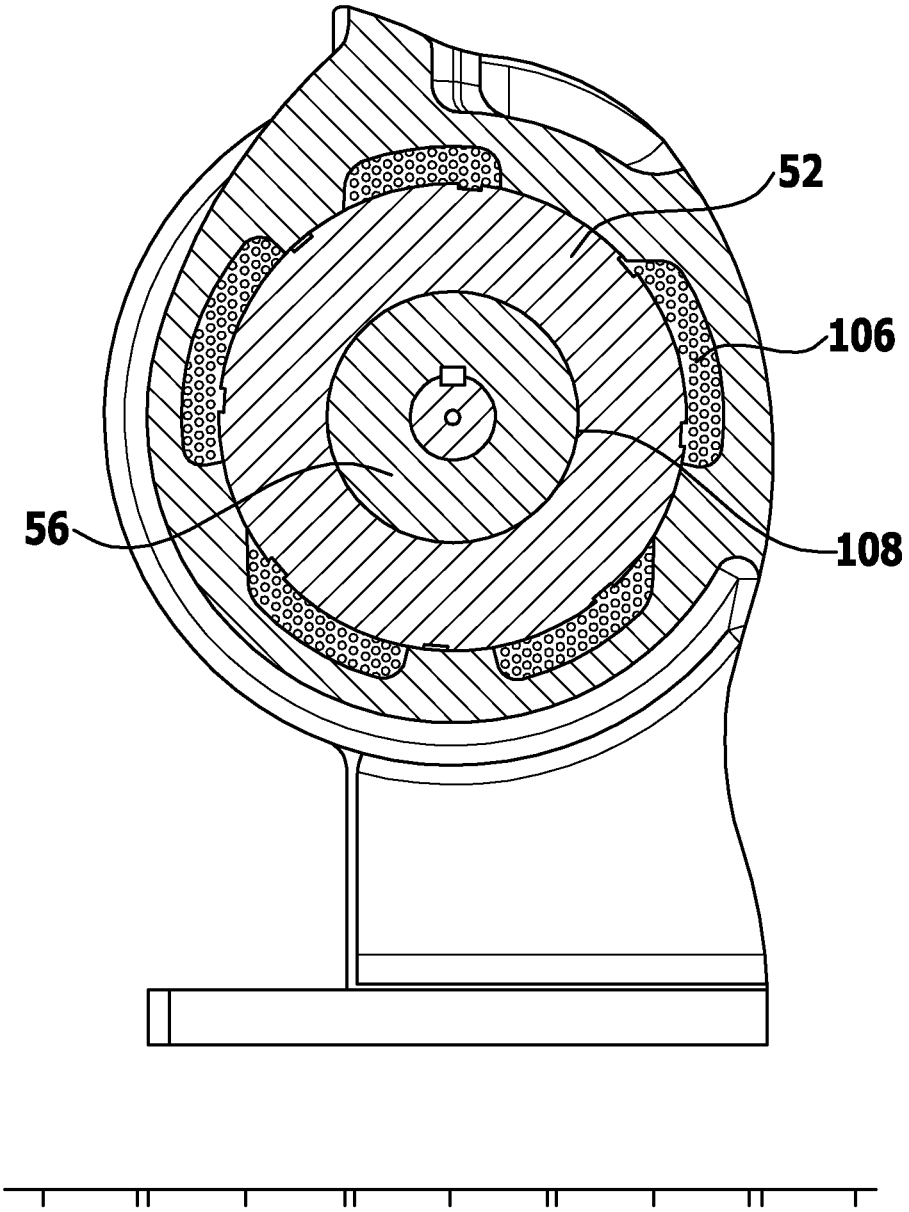
FIG. 9 a sectional view along the line 9-9 in FIG. 5.

Moreover for example, a flow path S4 is formed, and due to this as is illustrated in FIG. 9, the stator 52 is subjected to a flow in the region of the recesses 106 which run radially outwardly therefrom in the direction of the compressor housing 12 whereby it is cooled radially outwardly.

Preferably, the suction opening 94 in the cover 22 is arranged in such a way that the motor axis 54 passes therethrough, and in particular, the suction opening 94 is arranged to be coaxial with the motor axis 54 so that approximately rotationally symmetrical flow states relative to the motor axis 54 develop in the region of the interior space 100 and the bearing seating 86.

The guidance of the suction gases for the purposes of forming the flow paths S is effected on the one hand by the seating base 85 and the annular body 87 of the bearing seating 86 which form flow guidance surfaces 89 facing the suction gas flow, as well as by flow guidance surfaces 99 which are formed into the cover base 90 adjoining the suction opening 94 and which increasingly widen out commencing from the suction opening 94 with increasing extent in the direction of the compressor housing 12.

Figure 10:
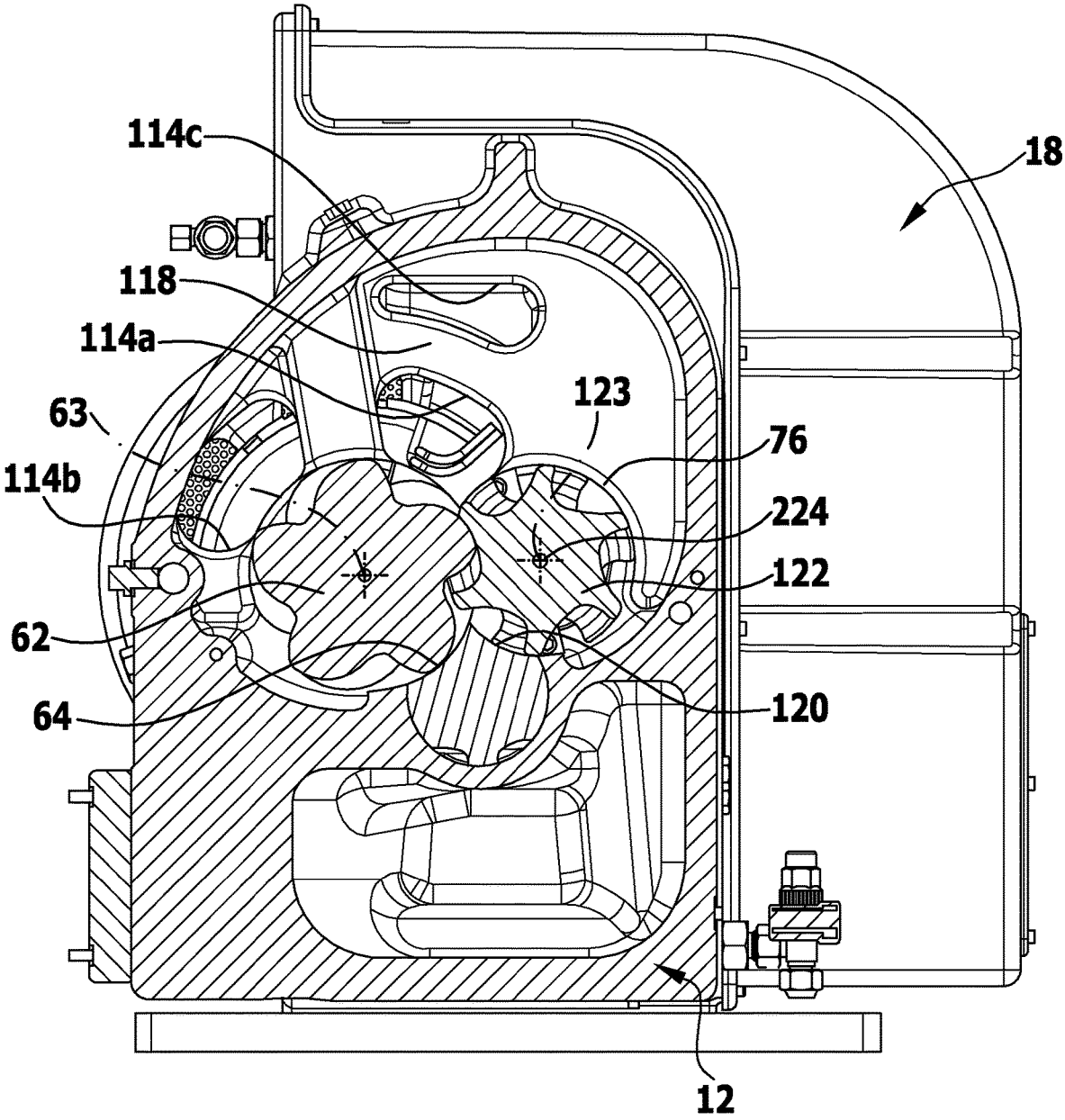
FIG. 10 a sectional view along the line 10-10 in FIG. 5.

After flowing through the recesses 106 and the gap 108, the suction gas collects in the region of the head windings 112 of the stator 52 facing the compressor housing 12 in an interior space 116 of the motor housing 14 on the compressor housing side and is thus able to also cool these head windings 112 before the sucked-in gas or refrigerant passes through through holes 114*a*, 114*b* and 114*c* provided in the suction-side wall 76 of the compressor housing 12 as illustrated in FIG. 10, and thereby enters a suction chamber 118 of the compressor housing 12.

Figure 11:
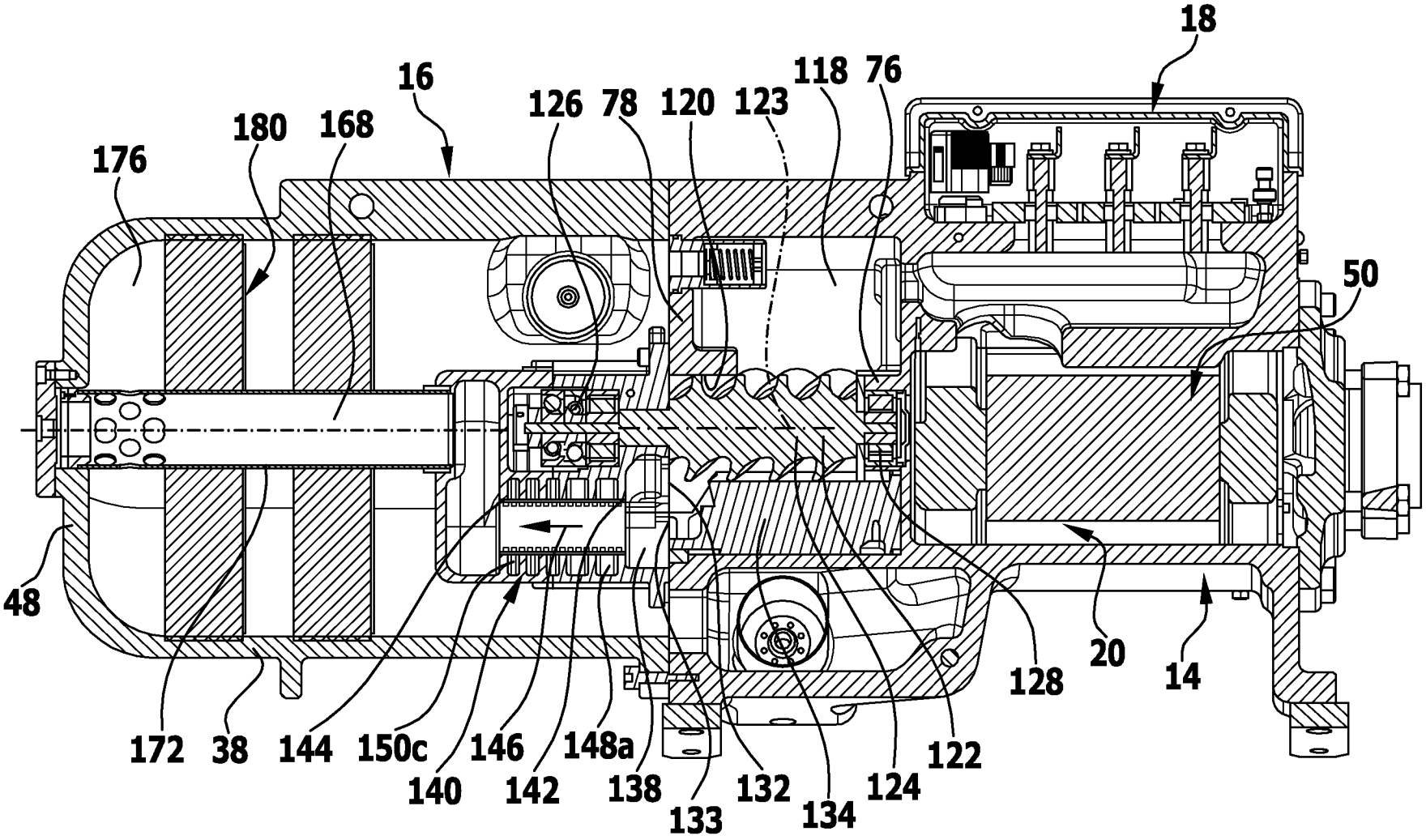
FIG. 11 a sectional view along the line 11-11 in FIG. 4.

As is illustrated in FIG. 10 and FIG. 11, apart from the first screw rotor 62, provision is made in addition for a second screw rotor 122 which is arranged in a screw rotor boring 120 and co-operates with the first one, wherein the second screw rotor 122 is also mounted in a pressure-side set of bearings 126 about a rotational axis 123 that is parallel to the motor axis 54 and the rotational axis 63 by means of an end face bearing shaft 124 which extends beyond the screw rotor 122 and is mounted in a suction-side set of bearings 128.

In operation, the two screw rotors 62 and 122 now co-operate in such a manner that refrigerant or gas is sucked in from the suction chamber 118, compressed by the inter-engaging screw rotors 62 and 122 and then, as a compressed gas or refrigerant, it exits into the compressor housing 12 in the region of a pressure-side outlet window 132 that is defined by the pressure-side vacant peripheral regions and the end-face regions of the screw rotors 62, 122 and passes on from the compressor housing 12 through a housing window 133 into the pressure housing 16.

Furthermore, for the purposes of adjusting the volume ratios, another slider 134 is provided, the construction and functioning of which are described in the German patent application 10 2011 051 730.8 for example.

Figure 12:
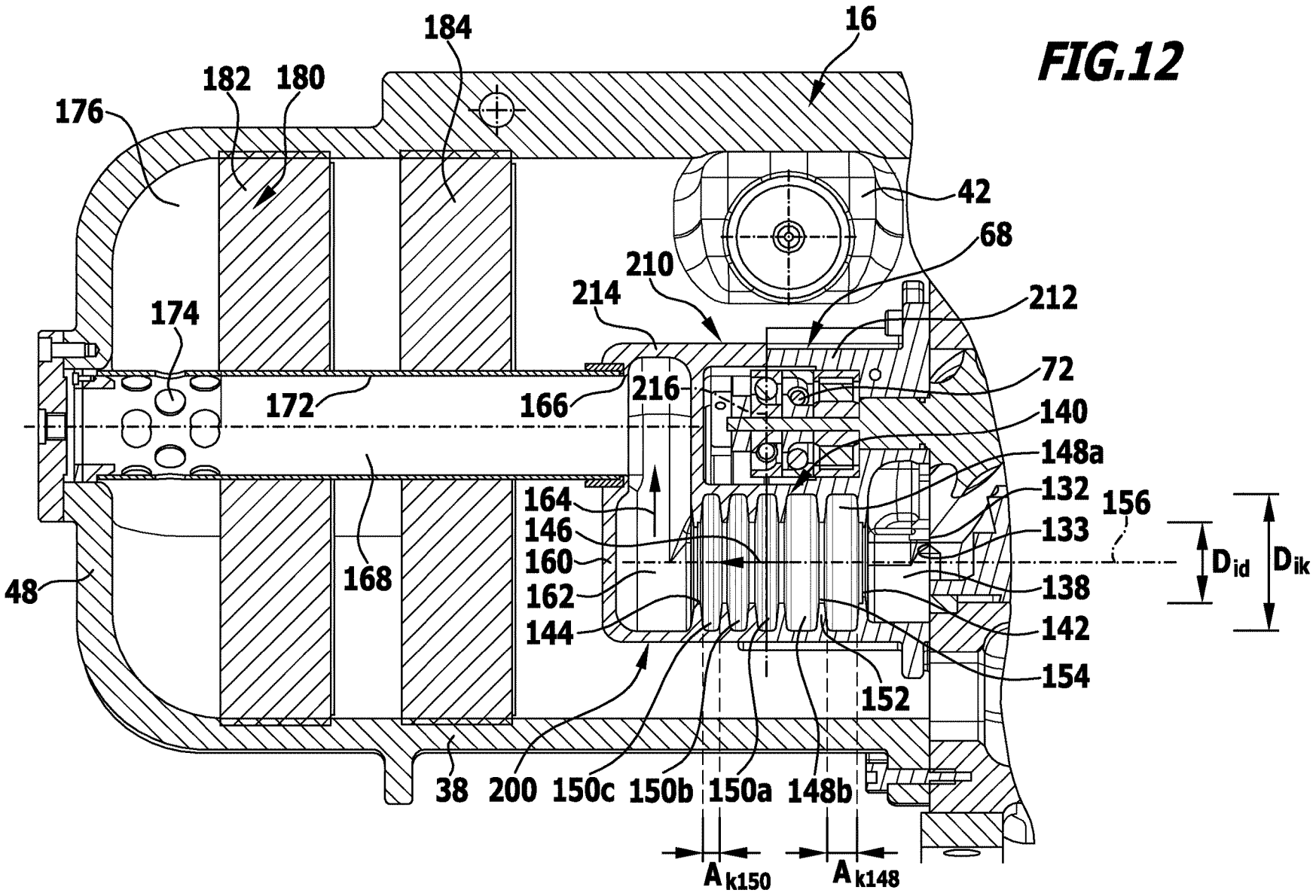
FIG. 12 an enlarged sectional view similar to FIG. 11 in the region of a pressure housing.

In order to dampen the pressure pulsations of the compressed gas or refrigerant emerging through the outlet window 132, there is provided in the pressure housing 16 directly adjoining the housing window 133, a first sound absorber unit 140 which comprises a receiving chamber 138 that directly adjoins the housing window 132, an inlet opening 142 that is arranged on a side of the receiving chamber 138 opposite the housing window 132 and an outlet opening 144 through which a flow is able to take place, in particular, in a direction of flow 146 directed transversely to the pressure-side wall 78 and away therefrom, especially parallel to the motor axis 54, wherein there are provided between the inlet opening 142 and the outlet opening 144 for example a plurality of chambers 148*a* and 148*b* as well as 150*a* 150*b* and 150*c* which widen out transverse to the direction of flow 146 and each of the chambers 148 and 150 is, as is illustrated in FIG. 12, separated by a partition wall 152 from the nearest adjacent chamber 148, 150, wherein each partition wall 152 comprises a passage opening 154 which restricts the flow and through which the compressed gas or compressed refrigerants can cross from one of the chambers 148, 150 to the next.

For reasons of simple fabrication in particular, the passage openings 154 are each formed in such a way that the extent thereof in the direction of flow 146 corresponds to the thickness of the partition wall 152 so that the passage openings merge without projections into the wall surfaces of the partition wall 152.

In like manner, the inlet opening 142 and the outlet opening 144 also merge without projection into the wall surface of the respectively adjoining chamber 148 or 150.

Preferably thereby, the chambers 148, 150 have different chamber volumes.

Different chamber volumes of this type can be achieved for example, in that the chambers 148, 150 have the same dimensions in a direction transverse to the direction of flow 146 or radially thereof, but have different dimensions in the direction of the flow direction 146.

In the exemplary embodiment in accord with FIGS. 11 and 12, the inlet opening 142, the passage openings 154 and the outlet opening 144 are arranged to be coaxial with a central axis 156 and, in the same way, the chambers 148 and 150 are also coaxial with the central axis 156 so that the first sound absorber unit 140 is formed such as to be rotationally symmetrical with respect to the central axis 156

In particular, the central axis 156 extends parallel to the rotational axes 63 and 123 of the respective screw rotor 62 and 122 and thus parallel to the motor axis 54.

For example, the chambers 148 and 150 have an internal diameter of $D_{ik}$ which amounts to more than 1.3 times, better still, more than 1.4 times the internal diameter $D_{id}$ of the passage openings 154 as well as the inlet opening 142 and the outlet opening 144.

Moreover, the extent $A_{K148}$ of the individual chambers 148 amounts to more than approximately 0.2 times, still better, to more than approximately 0.23 times the internal diameter $D_{ik}$ of the chambers 148, 150.

Maximally, the extent of the chambers 148, 150 in the direction of the central axis 156 corresponds to the internal diameter $D_{ik}$ of the chambers 148, 150, and still better, a maximum value of $D_{ik}$ is half the internal diameter $D_{ik}$ of the chambers 148.

By contrast, the extent $A_{k150}$ of the chambers 150 amounts to more than approximately 0.1 times the internal diameter $D_{ik}$ of the chambers 150.

Following the first sound absorber unit 140, there is for example in addition a second sound absorber unit 160 which comprises a transverse flow chamber 162 which directly adjoins the outlet opening 144 and through which the compressed gas or refrigerant emerging from the first sound absorber unit 140 can flow in a direction of flow 164 running transversely relative to the direction of flow 146 in the direction of an outlet 166 of the second sound absorber unit 160 by means of which the compressed gas or refrigerant is then fed in a channel 168, formed for example by a pipe 172, up to the end wall 48 of the jacket 38 where it emerges radially through openings 174 in the pipe 172 and enters the pressure space 176 of the pressure housing 16 enclosing the pipe 172.

Surrounding the channel 168 and in particular the pipe 172, there is arranged in the pressure space 176 of the pressure housing 16 a lubricant separating unit 180 which, for example, comprises two sets of porous gas-permeable structures 182 and 184, made of metal for example, which cater for the separation of lubricant spray from the pressurised gas or refrigerant.

After flowing through the lubricant separating unit 180, it is then possible for the pressurised gas or refrigerant to emerge from the pressure housing 16 through the pressure outlet 42.

The lubricant collecting in the lubricant separating unit 180 forms a lubricant bath 190 located, in the direction of the force of gravity, in the lower region of the pressure housing 16 and the compressor housing 12, and from there lubricant is taken, filtered by a filter 192 and then used for lubricating purposes.

In connection with the previous description of the first sound absorber unit 140 and the second sound absorber unit 160, nothing was mentioned about their arrangement.

Preferably, both the first sound absorber unit 140 and the second sound absorber unit 160 are arranged in a sound absorber housing 200 which, for example, is integrated into the bearing housing 68 or is formed thereon so that the bearing housing 68 and the sound absorber housing 200 together form a combined housing 210 which is arranged within the pressure housing 16 and which, for its part, is carried by the pressure-side wall 78 of the compressor housing 12

The combined housing 210 can thereby be constructed in the most varied of manners for the purposes of forming the bearing housing 68 on the one hand and for the purposes of forming the sound absorber housing 200 on the other.

Preferably, the combined housing 210 is constructed in two parts and comprises a basic housing 212 which is connected to the pressure-side wall 78 of the compressor housing 12 and which accommodates the pressure-side sets of bearings 72 and 126 and in addition a part of the chambers 148 and 150, for example the chambers 148 and a part of the chambers 150.

There is seated on the basic housing 212 and rigidly connected thereto a covering housing 214 which receives the transverse flow chamber 162 and a part of the chambers 150 and forms a cover for the pressure-side sets of bearings 72 and 126.

Commencing from the covering housing 214, the pipe 172 then extends in the direction of the end wall 48.

In particular, the basic housing 212 and the covering housing 214 are separable by a geometrical separating plane 216 which runs transversely, preferably perpendicularly to the rotational axes 63, 123 of the screw rotors 62, 122.

The combined housing 210 can advantageously be produced in the form of a cast part into which the sound absorber units 140, 160 as well as the bearing housing 68 are formable by the mould so as to be close to their final contour.

Lubrication of the guide bearing 84 and possibly too the sets of bearings 72 and 74 as well as 126 and 128 is effected through central lubrication channels 222 and 224 of the drive shaft 58 or the bearing shaft 124 which supply the guide bearing 84 and, if necessary, the sets of bearings 72 and 74, 126 and 128 with oil for lubrication purposes.

Figure 13:
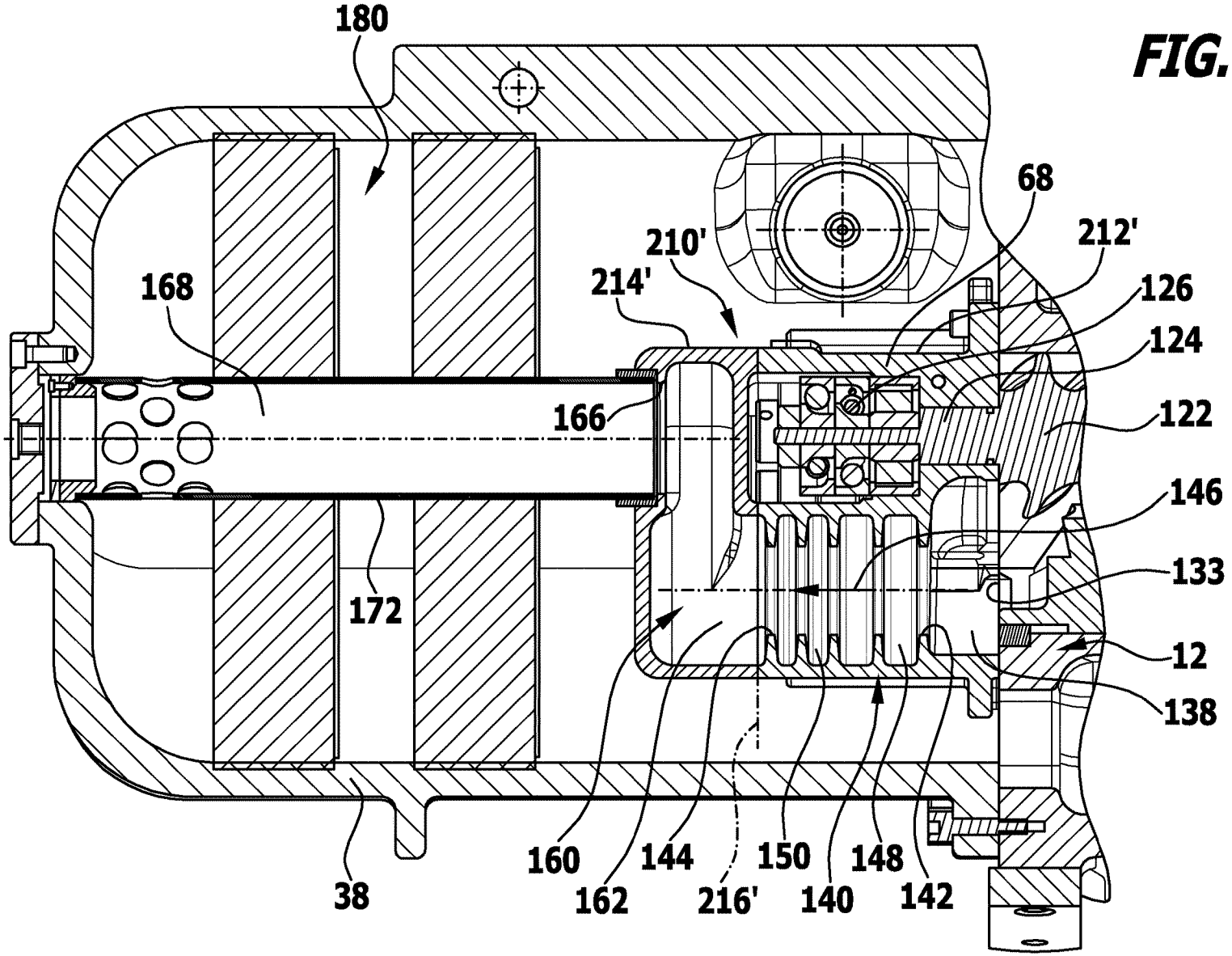
FIG. 13 an illustration similar to FIG. 12 of a second exemplary embodiment of a refrigerant compressor in accordance with the invention.

In one exemplary embodiment of a refrigerant compressor in accordance with the invention that is illustrated in FIG. 13, the combined housing 210 is formed in such a way that the separating plane 216' between the basic housing 212' and the covering housing 214' runs at a spacing from the compressor housing 12 which is such that all of the chambers 148 and 150 of the first sound absorber unit 140 are located in the basic housing 212 and the outlet opening 144 is also located in the basic housing 212' so that the transverse flow chamber 162 of the sound absorber unit 160 is arranged in the covering housing 214' as is also the outlet 166 of the second sound absorber unit 160.

Thus, the part of the bearing housing 68 that is arranged in the basic housing 212' also has an extent which is such that the sets of bearings 72 and 126 are arranged therein and the covering housing part 214' merely comprises another cover of the bearing housing 68 which covers the remaining part of the bearing housing 68 that is arranged in the basic housing 212'.

In all other respects, the second exemplary embodiment is constructed in the same way as the first exemplary embodiment so that for full details reference can be made to the remarks made in regard thereto in connection with the first exemplary embodiment and in addition, identical reference symbols are made use of for identical parts.

Figure 14:
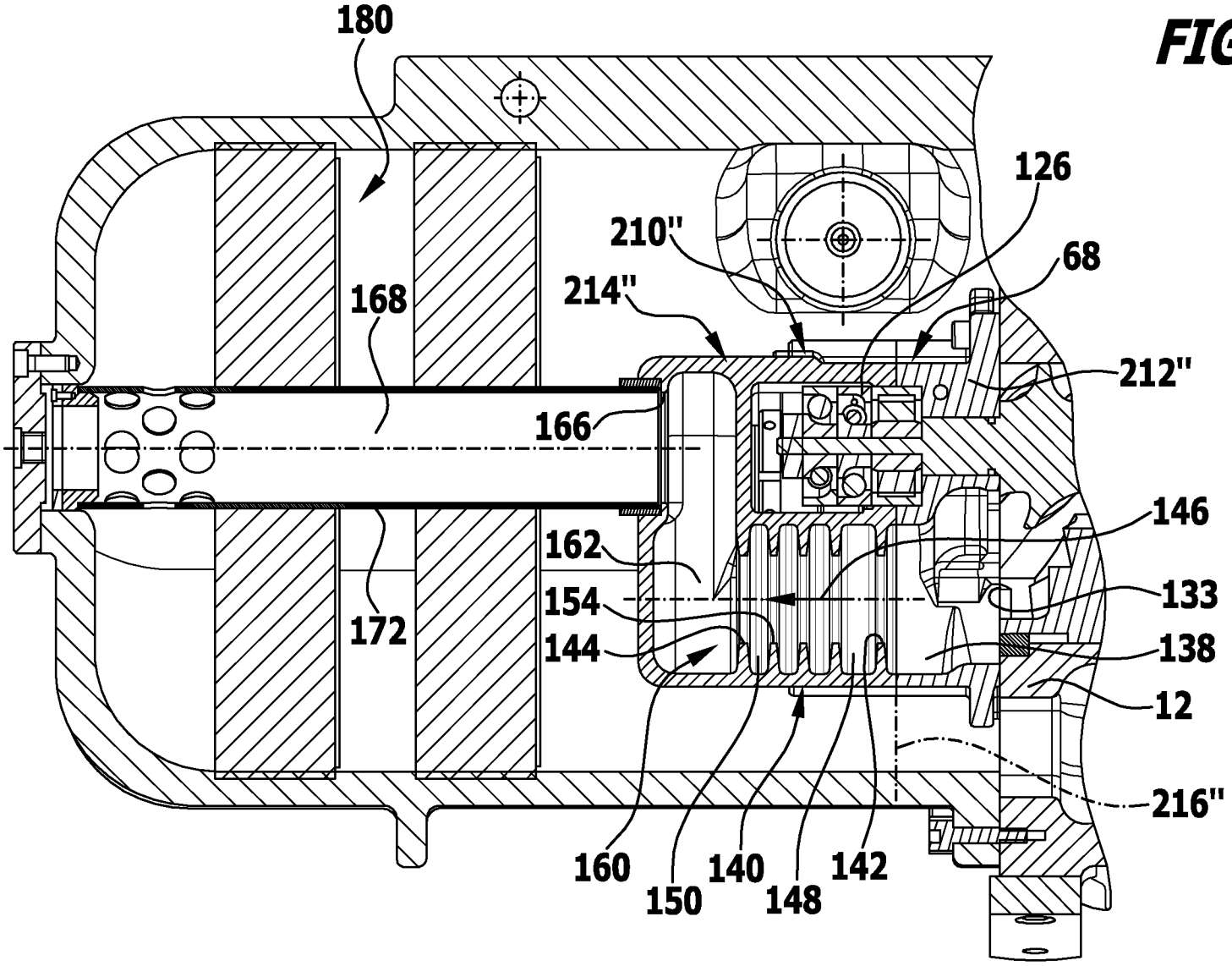
FIG. 14 an illustration similar to FIG. 12 of a third exemplary embodiment of a refrigerant compressor in accordance with the invention.

In a third exemplary embodiment of a refrigerant compressor in accordance with the invention that is illustrated in FIG. 14, the combined housing 210" is constructed differently once again, namely, in such a manner that, commencing from the compressor housing 12, the basic housing 212" has a minimal extent and thus, with respect to the first sound absorber unit 140, merely comprises the receiving chamber 138, whereas the inlet opening 142 and thus too, the chambers 148 and 150 are arranged in the covering housing 214", and, moreover, the covering housing 214" also accommodates the entire second sound absorber unit 160, including especially, the transverse flow chamber 162 and the outlet 166.

However, due to the position of the separating plane 216", a substantial part of the bearing housing 68 is not arranged in the basic housing 212", but rather, it is arranged in the covering housing 214" so that a substantial part of the sets of bearings 72 and 126 is located in the covering housing 214" and not in the basic housing 212".

In all other respects, the third exemplary embodiment is also constructed in the same way as regards the remaining features in an identical manner to the preceding exemplary embodiments so that for full details reference can be made to the remarks made in regard to the preceding exemplary embodiments and in addition, identical parts are likewise provided with identical reference symbols.

In the case of the first to third exemplary embodiment, the sound absorber units 140 and 160 are in the form of so-called passage absorbers, i.e. that at least one chamber is located between the inlet opening 142 and the outlet opening 144, for example the chambers 148 and 150 which, for their part, are again separated from each other by passage openings 154 so that the compressed gas or the compressed refrigerant is subjected to a flow-constricting process followed by an expansion process a plurality of times whilst flowing through the sound absorber units 140 and 160.

In contrast thereto, a first sound absorber unit 240 is provided in place of the first sound absorber unit 140 in the following fourth to seventh exemplary embodiments, but although the direction of flow 146 therethrough is likewise parallel to the rotational axes 63 and 123 of the screw rotor 62 and 122, they work on a different principle.

In a sound absorber unit 240 of this type which is in the form of a Helmholtz absorber, a tubing section 242 extends between the inlet opening 142 and the outlet opening 144 as well as through the passage openings 154 and the chambers 148 and 150, this section forming a through-flow channel 244 which extends between the inlet opening 142 and the outlet opening 144.

For its part, the tubing section 242 is provided with a multiplicity of break-throughs 246 which produce a connection to one or more damping spaces 248 and 250 which surround the tubing section 242 in ring-like manner and are located in the chambers 148 and 150 around the tubing section 242, wherein the spaces 148 and 150 are formed in the sound absorber housing 200 in like manner to the preceding exemplary embodiments.

In a Helmholtz absorber, the annular volumes of the damping spaces 248 and 250 extending around the tubing section 242 are thus coupled via the number of break-throughs 246 associated with each of the damping spaces 248 and 250 to the through-flow channel 244, wherein the self resonance of the Helmholtz resonator depends on the respective annular volume of the damping spaces 248 and 250, on the cross-sectional area with which the respective chamber is coupled to the through-flow channel 244, i.e. on the sum of the break-throughs 246 associated with each of the damping space areas 248 and 250 and on the radial extent of the break-throughs 246 in the tubing section 242.

The damping factor of the first sound absorber unit 240 can thus be determined by suitable choice of the damping spaces 248 and 250 as well as the number of break-throughs 246 in the tubing section 242.

In regard to the further detailed functioning of the Helmholtz resonator and the computation of the frequencies, reference is made to the contents of the book "Ingenieur-akustic" by Henn, Sinambari, Fallen, $4^{th}$ revised edition, pages 304 to 309.

Figure 15:
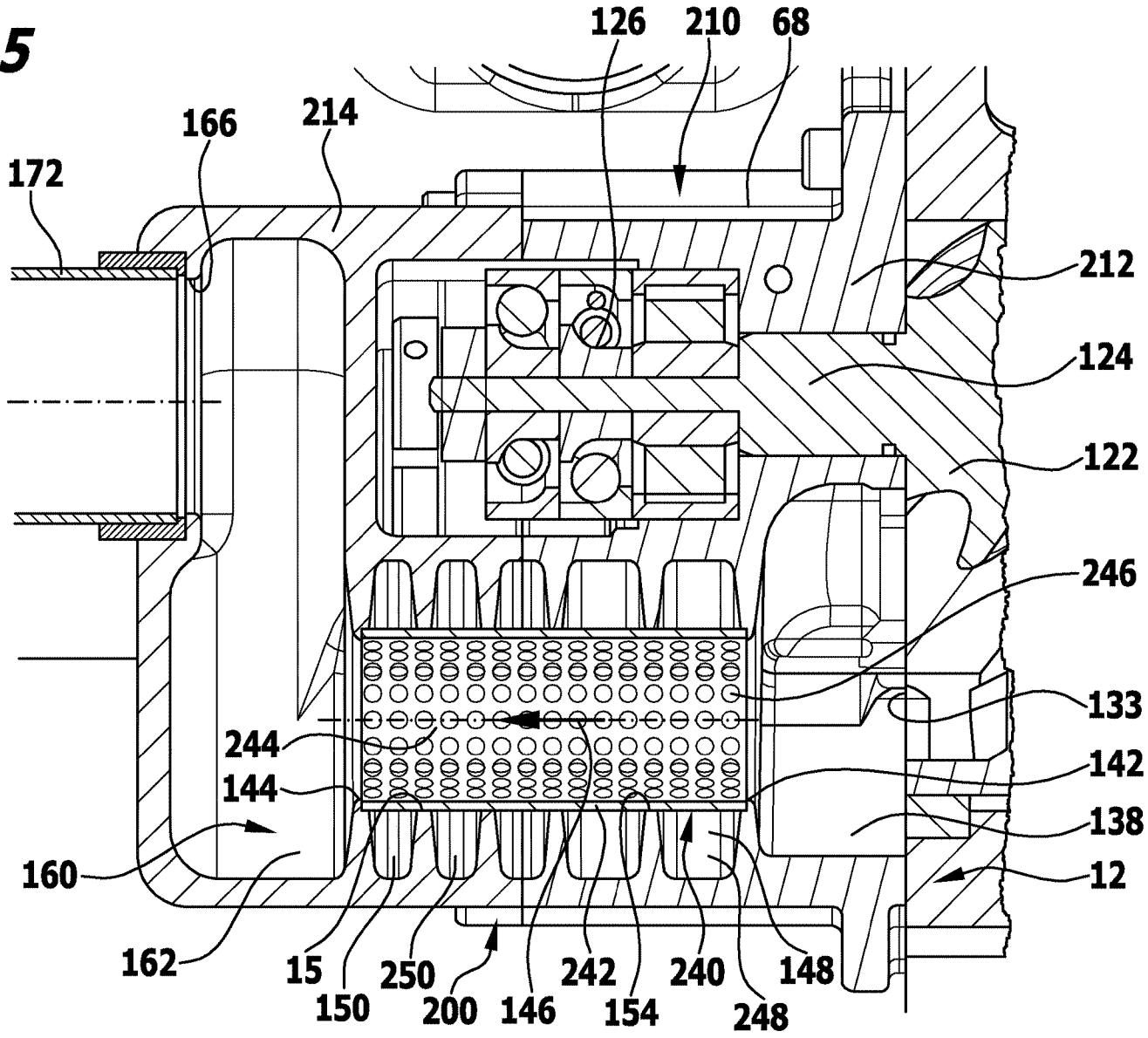
FIG. 15 an illustration similar to FIG. 12 of a fourth exemplary embodiment of a refrigerant compressor in accordance with the invention.

Otherwise in the case of the fourth exemplary embodiment in accordance with FIG. 15, the second sound absorber unit 160 is still provided in the sound absorber housing 200 and the sound absorber housing 200 furthermore is part of the combined housing 210 which is formed by the basic housing 212 and the covering housing 214 in the same way as in the preceding exemplary embodiments.

In all other respects regarding all other features of the refrigerant compressor in accordance with the fourth exemplary embodiment, reference is made in full to the remarks made in respect of the preceding exemplary embodiments, wherein identical elements are provided with identical reference symbols.

Figure 16:
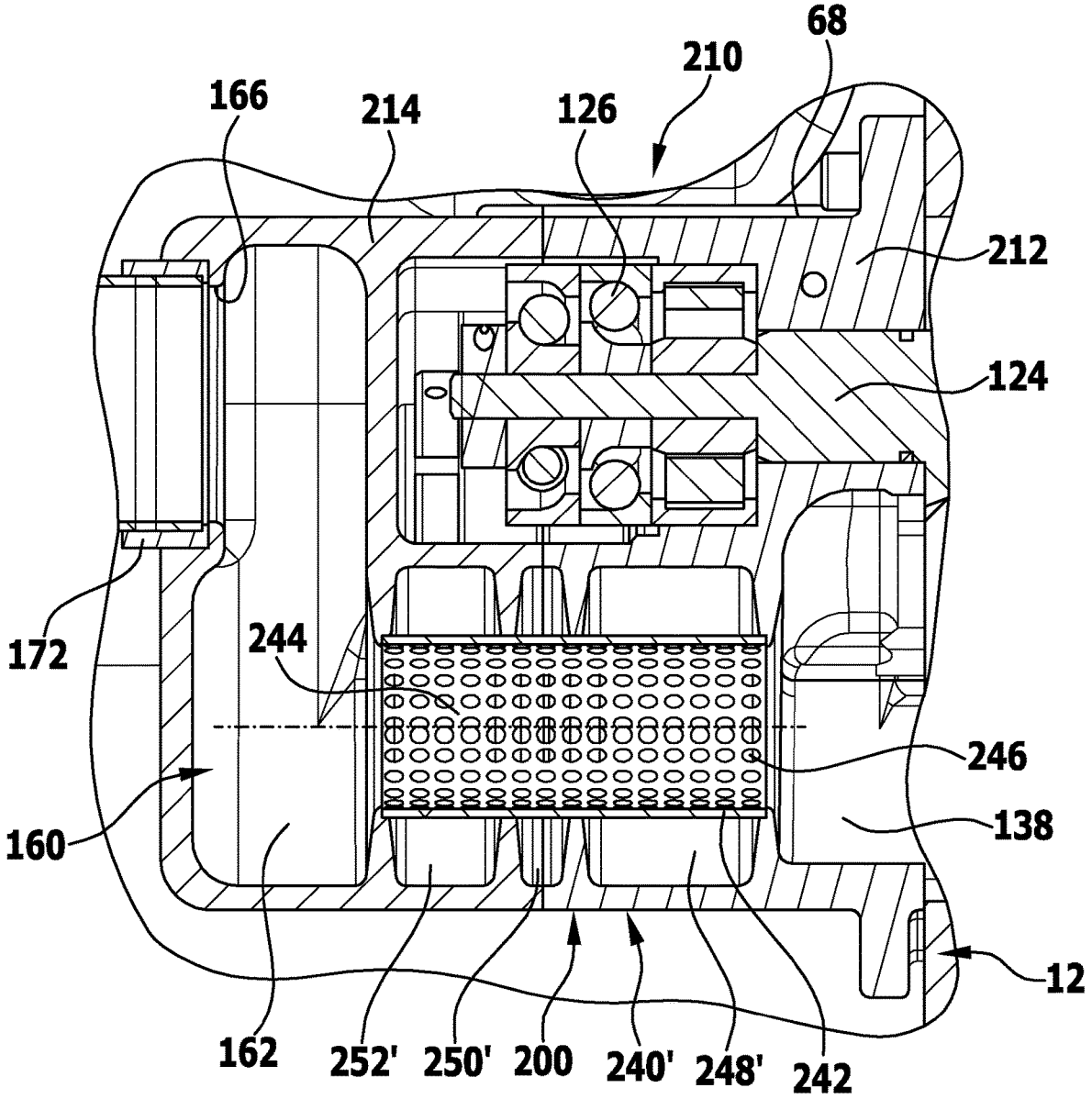
FIG. 16 an illustration similar to FIG. 12 of a fifth exemplary embodiment of a refrigerant compressor in accordance with the invention.

In a fifth exemplary embodiment of a refrigerant compressor in accordance with the invention that is illustrated in FIG. 16, the sound absorber unit 240' likewise works as a Helmholtz absorber, wherein the tubing section 242 comprising the break-throughs 246 and forming the through-flow channel 244 is provided in the same way as for the fourth exemplary embodiment.

However, in this exemplary embodiment, the break-throughs 246 couple to three annular damping spaces 248, 250 and 252 of differing size in order to thereby open up the possibility of matching the damping process to different frequencies of the compressed gas or refrigerant.

In connection therewith, the number and the volume of the damping spaces 248, 250 and 252 can vary in dependence on the frequencies that are to be absorbed.

Figure 17:
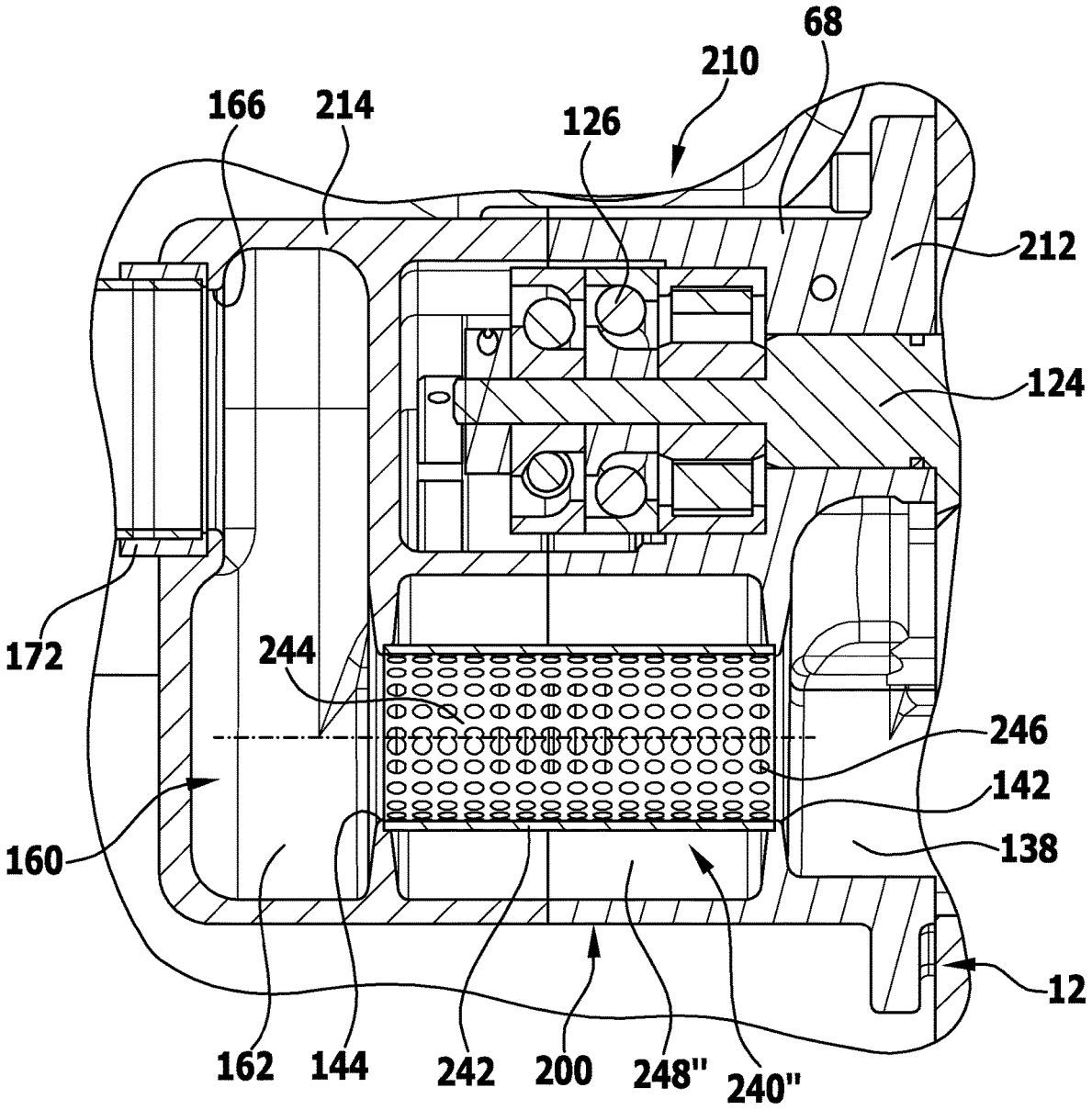
FIG. 17 an illustration similar to FIG. 12 of a sixth exemplary embodiment of a refrigerant compressor in accordance with the invention and FIG. 18 an illustration similar to FIG. 12 of a seventh exemplary embodiment of a refrigerant compressor in accordance with the invention.

In the extreme case in a sixth exemplary embodiment that is illustrated in FIG. 17, provision is made for only one damping space 248 which is coupled via the break-throughs 246 of the tubing section 242 to the through-flow channel 244, wherein the damping process is primarily attuned to one frequency in this solution.

Figure 18:
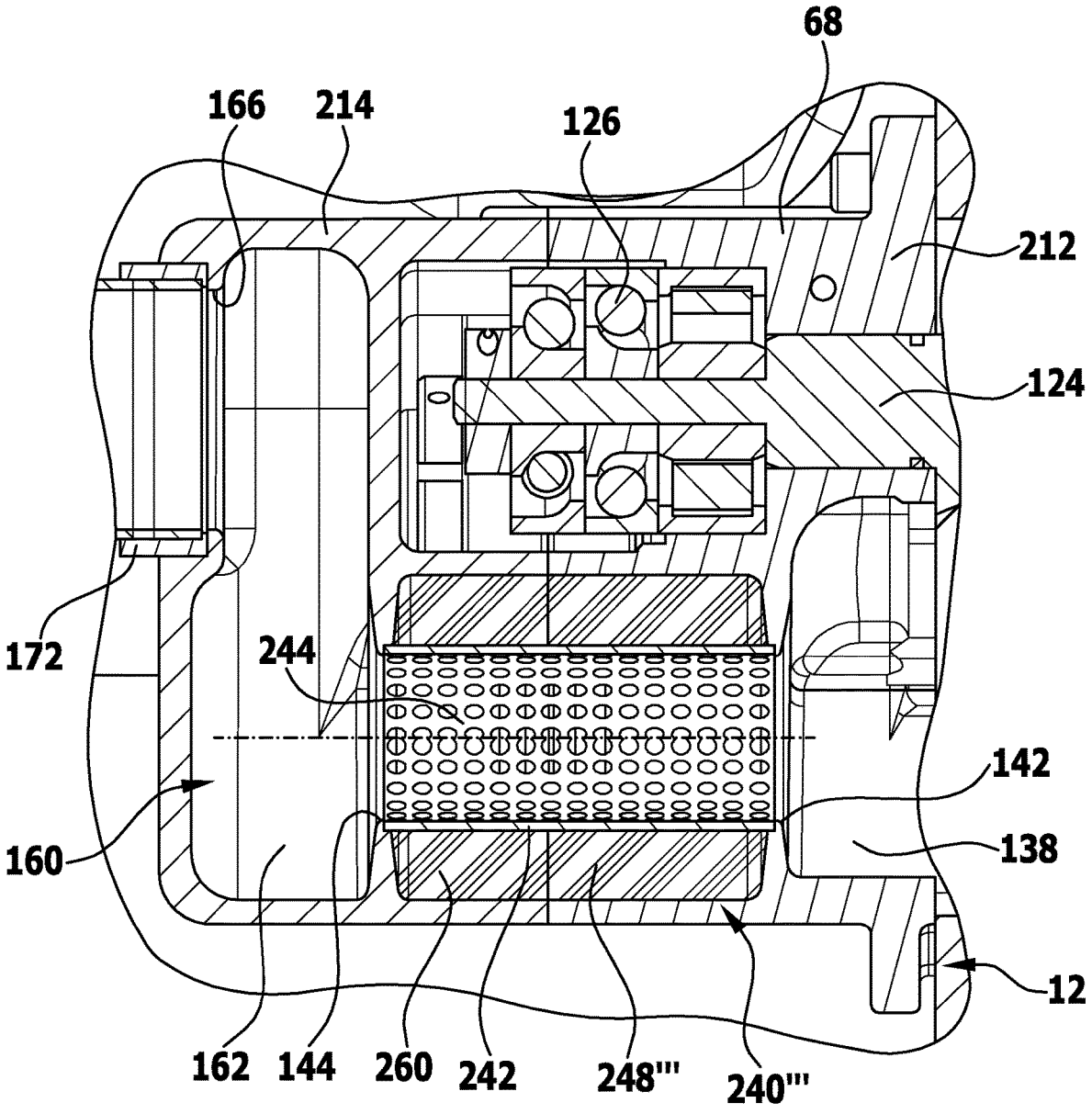

A variation of the sixth exemplary embodiment serving as a seventh exemplary embodiment that is illustrated in FIG. 18 additionally envisages that sound-damping materials 260 be provided in the damping space 248" which is approximately identical to the sixth exemplary embodiment.

In all other respects, the seventh exemplary embodiment is constructed in the same way as the sixth exemplary embodiment, so that reference should be made to the content of the remarks made in regard to the sixth exemplary embodiment.

The invention claimed is:

1. A refrigerant compressor comprising a common housing, a screw-type compressor which is provided in the common housing and has a compressor housing that is formed as part of the common housing and in which there is arranged at least one screw rotor boring, at least one screw rotor that is arranged in the screw rotor boring such as to be rotatable about a rotational axis, a suction-side bearing unit for the screw rotor that is arranged on the compressor housing, at least one pressure-side bearing unit for the screw rotor that is arranged on the compressor housing and a housing window for compressed refrigerant that is provided on the compressor housing, and a first sound absorber unit which is arranged in the common housing and within the refrigerant compressor, the first sound absorber unit is arranged after the housing window, and in that the sound absorber unit comprises at least one chamber which is located between an inlet opening and an outlet opening and which widens out relative to the inlet opening and to the outlet opening in a direction transverse to a direction of flow, the first sound absorber unit is in the form of a passage absorber which comprises a plurality of passage openings and a plurality of expansion chambers, each of the expansion chambers following one of the passage openings, and in that the inlet opening and the outlet opening respectively each form one of the passage openings with the plurality of expansion chambers being of differing volume, the common housing comprising a motor housing arranged on one side of the compressor housing and a pressure housing arranged on a side of said compressor housing opposite to said motor housing and the first sound absorber unit is arranged in the pressure housing of the common housing, and wherein a sound absorber housing and a bearing housing form parts of a combined housing for the first sound absorber unit and the pressure-side bearing unit, wherein the first sound absorber unit is disposed radially outwardly and in axially overlapping relationship with the at least one pressure-side bearing unit.

2. The refrigerant compressor in accordance with claim 1, wherein the first sound absorber unit is arranged in the sound absorber housing adjoining the compressor housing in a region of the housing window.

3. The refrigerant compressor in accordance with claim 2, wherein the sound absorber housing fits tightly around the housing window.

4. The refrigerant compressor in accordance with claim 2, wherein the sound absorber housing itself forms the inlet opening, the outlet opening and the at least one chamber.

5. The refrigerant compressor in accordance with claim 1, wherein the sound absorber housing is arranged beside the bearing housing which accommodates the at least one pressure-side bearing unit.

6. The refrigerant compressor in accordance with claim 1, wherein the sound absorber housing is held on the compressor housing.

7. The refrigerant compressor in accordance with claim 1, wherein the combined housing comprises a basic housing and a covering housing.

8. The refrigerant compressor in accordance with claim 7, wherein the basic housing and the covering housing are separable by a separating plane running transversely relative to the rotational axis of the at least one screw rotor.

9. The refrigerant compressor in accordance with claim 7, wherein at least a part of the bearing housing and at least a part of the sound absorber housing are formed in the basic housing.

10. The refrigerant compressor in accordance with claim 7, wherein at least a part of the at least one chamber of the sound absorber unit is formed in the basic housing.

11. The refrigerant compressor in accordance with claim 10, wherein partition walls are formed between the expansion chambers in the basic housing.

12. The refrigerant compressor in accordance with claim 7, wherein the basic housing is a one-piece part.

13. The refrigerant compressor in accordance with claim 7, wherein the covering housing is a one-piece part.

14. The refrigerant compressor in accordance with claim 1, wherein the first sound absorber unit comprises a receiving chamber adjoining the housing window, the inlet opening following thereafter.

15. The refrigerant compressor in accordance with claim 1, wherein the first sound absorber unit is arranged in such a way that the compressed refrigerant is adapted to flow therethrough in a direction of flow which runs transversely relative to a pressure-side wall of the compressor housing and away therefrom.

16. The refrigerant compressor in accordance with claim 1, wherein a plurality of the passage openings of the sound absorber unit have identical cross sections.

17. The refrigerant compressor in accordance with claim 1, wherein the expansion chambers of differing volume have a different extent in the direction of flow.

18. The refrigerant compressor in accordance with claim 1, wherein the sound absorber unit comprises a tubing section which extends from the inlet opening to the outlet opening and forms a through-flow channel and which comprises casing-side through holes that open out into at least one damping space which is arranged in the at least one chamber and adjoins the tubing section.

19. The refrigerant compressor in accordance with claim 18, wherein the tubing section passes through a plurality of chambers each of which forms a damping space that adjoins the tubing section.

20. The refrigerant compressor in accordance with claim 19, wherein the sound absorber unit comprises at least two damping spaces which have a different volume.

21. The refrigerant compressor in accordance with claim 20, wherein the damping spaces of differing volume have a differing extent in the longitudinal direction of the tubing section.

22. The refrigerant compressor in accordance with claim 1, wherein the pressure housing extends over the sound absorber housing.

23. The refrigerant compressor in accordance with claim 22, wherein the sound absorber housing is surrounded by a pressure space located in the pressure housing.

24. The refrigerant compressor in accordance with claim 1, wherein a lubricant separating unit is arranged in the pressure housing.

25. The refrigerant compressor in accordance with claim 24, wherein the lubricant separating unit is arranged downstream of the at least one sound absorber unit.

26. The refrigerant compressor in accordance with claim 1, wherein the first sound absorber unit is free of any outlet window for working medium between the inlet opening and the outlet opening.

27. The refrigerant compressor in accordance with claim 1, wherein the combined housing comprises an intermediate radially extending parting plane of assembled housing component parts that extends transversely through the rotational axis.

28. The refrigerant compressor in accordance with claim 1, wherein the first sound absorber unit defines an axially extending non-meandering flow path between the inlet opening and the outlet opening.

29. A refrigerant compressor comprising a common housing, a screw-type compressor which is provided in the common housing and has a compressor housing that is formed as part of the common housing and in which there is arranged at least one screw rotor boring, at least one screw rotor that is arranged in the screw rotor boring such as to be rotatable about a rotational axis, a suction-side bearing unit for the screw rotor that is arranged on the compressor housing, at least one pressure-side bearing unit for the screw rotor that is arranged on the compressor housing and a housing window for compressed refrigerant that is provided on the compressor housing, and a first sound absorber unit which is arranged in the common housing and within the refrigerant compressor, the first sound absorber unit is arranged after the housing window, and in that the sound absorber unit comprises at least one chamber which is located between an inlet opening and an outlet opening and which widens out relative to the inlet opening and to the outlet opening in a direction transverse to a direction of flow, the first sound absorber unit is in the form of a passage absorber which comprises a plurality of passage openings and a plurality of expansion chambers, each of the expansion chambers following one of the passage openings, and in that the inlet opening and the outlet opening respectively each form one of the passage openings with the plurality of expansion chambers being of differing volume, the common housing comprising a motor housing arranged on one side of the compressor housing and a pressure housing arranged on a side of said compressor housing opposite to said motor housing and the first sound absorber unit is arranged in the pressure housing of the common housing; and wherein a sound absorber housing and a bearing housing form parts of a combined housing, wherein the combined housing integrally provides the first sound absorber unit and houses the at least one pressure-side bearing unit, and wherein the first sound absorber unit is disposed radially outwardly and in axially overlapping relationship with the at least one pressure-side bearing unit.

30. The refrigerant compressor of claim 29, wherein the combined housing entirely provides the first sound absorber unit and houses the at least one pressure-side bearing unit.

31. The refrigerant compressor in accordance with claim 29, wherein the first sound absorber unit is free of any outlet window for working medium between the inlet opening and the outlet opening.

32. The refrigerant compressor in accordance with claim 29, wherein the combined housing comprises an intermediate radially extending parting plane of assembled housing component parts that extends transversely through the rotational axis.

33. The refrigerant compressor in accordance with claim 29, wherein the first sound absorber unit defines an axially extending non-meandering flow path between the inlet opening and the outlet opening.

34. A refrigerant compressor comprising a common housing, a screw-type compressor which is provided in the common housing and has a compressor housing that is formed as part of the common housing and in which there is arranged at least one screw rotor boring, at least one screw rotor that is arranged in the screw rotor boring such as to be rotatable about a rotational axis, a suction-side bearing unit for the screw rotor that is arranged on the compressor housing, at least one pressure-side bearing unit for the screw rotor that is arranged on the compressor housing and a housing window for compressed refrigerant that is provided on the compressor housing, and a first sound absorber unit which is arranged in the common housing and within the refrigerant compressor, the first sound absorber unit is arranged after the housing window, and in that the sound absorber unit comprises at least one chamber which is located between an inlet opening and an outlet opening and which widens out relative to the inlet opening and to the outlet opening in a direction transverse to a direction of flow, the first sound absorber unit is in the form of a passage absorber which comprises a plurality of passage openings and a plurality of expansion chambers, each of the expansion chambers following one of the passage openings, and in that the inlet opening and the outlet opening respectively each form one of the passage openings with the plurality of expansion chambers being of differing volume, the common housing comprising a motor housing arranged on one side of the compressor housing and a pressure housing arranged on a side of said compressor housing opposite to said motor housing and the first sound absorber unit is arranged in the pressure housing of the common housing; and wherein a sound absorber housing and a bearing housing form parts of a combined housing for the first sound absorber unit and the at least one pressure-side bearing unit, wherein the first sound absorber unit supports the at least one pressure-side bearing unit.

35. The refrigerant compressor in accordance with claim 34, wherein the first sound absorber unit is free of any outlet window for working medium between the inlet opening and the outlet opening.

36. The refrigerant compressor in accordance with claim 34, wherein the combined housing comprises an intermediate radially extending parting plane of assembled housing component parts that extends transversely through the rotational axis.

37. The refrigerant compressor in accordance with claim 34, wherein the first sound absorber unit defines an axially extending non-meandering flow path between the inlet opening and the outlet opening.

* * * * *